US009187228B2

(12) United States Patent
Vogt et al.

(10) Patent No.: US 9,187,228 B2
(45) **Date of Patent: *Nov. 17, 2015**

(54) PACKAGE INTEGRITY INDICATING CLOSURE

(71) Applicant: Intercontinental Great Brands LLC, East Hanover, NJ (US)

(72) Inventors: Carole A. Vogt, Budd Lake, NJ (US); Jeffrey Thomas Weber, Lake Zurich, IL (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/669,811

(22) Filed: Nov. 6, 2012

(65) Prior Publication Data

US 2013/0064934 A1 Mar. 14, 2013

Related U.S. Application Data

(63) Continuation of application No. 11/693,751, filed on Mar. 30, 2007, now Pat. No. 8,408,792.

(51) Int. Cl.
*B65D 33/14* (2006.01)
*B65D 75/58* (2006.01)
*B65D 77/20* (2006.01)

(52) U.S. Cl.
CPC ..... *B65D 75/5838* (2013.01); *B65D 77/206* (2013.01); *B65D 77/2096* (2013.01); (Continued)

(58) Field of Classification Search
CPC ..... B65D 75/5838; B65D 2575/586; B65D 75/5833; B65D 2101/00
USPC ..... 383/203, 5, 116, 210, 211, 207, 208, 383/106; 229/117.31, 247
See application file for complete search history.

(56) References Cited

U.S. PATENT DOCUMENTS 401,974 A 4/1889 Smith
811,092 A 1/1906 Roberts
(Continued)

FOREIGN PATENT DOCUMENTS

AU 768679 6/2001
BR 55008852 11/2001
(Continued)

OTHER PUBLICATIONS

'Cheese Range', Mintel gnpd, Jan. 26, 2001, Mintel Publishing, 1 page.
(Continued)

*Primary Examiner* — Jes F Pascua
(74) *Attorney, Agent, or Firm* — Fitch, Even, Tabin & Flannery LLP

(57) ABSTRACT

A resealable closure for a container or package in which package integrity is indicated by a structure which breaks and/or produces an audible sound when the resealable closure is opened for a first time. The package integrity feature, in one form includes at least one strip or frangible structure that is initially affixed to two portions which comprise the resealable closure so that upon opening the resealable closure for a first time, at least one of the strips breaks. The strips may include a weakened portion such as a narrowing. Integrity of the package is indicated by an intact strip viewable upon opening the resealable closure and conversely, a broken or non-intact strip would indicate that the resealable closure has been previously opened. Package integrity may also be shown by a movable second panel or movable die cut tab portions.

23 Claims, 11 Drawing Sheets

(52) U.S. Cl.
CPC ..... *B65D2101/00* (2013.01); *B65D 2203/12* (2013.01); *B65D 2575/586* (2013.01); *B65D 2577/205* (2013.01); *B65D 2577/2033* (2013.01); *B65D 2577/2066* (2013.01); *B65D 2577/2091* (2013.01)

(56) References Cited

U.S. PATENT DOCUMENTS

| | | | | |
|---|---|---|---|---|
| 1,065,012 | A | | 6/1913 | Watanabe |
| 1,106,721 | A | | 8/1914 | Lewis |
| 1,171,462 | A | | 2/1916 | Rice |
| 1,791,352 | A | | 2/1931 | Pascual |
| 1,963,639 | A | | 6/1934 | Ahlquist |
| 1,978,035 | A | | 10/1934 | Thom |
| 2,033,550 | A | | 3/1936 | Rosen |
| 2,034,007 | A | | 3/1936 | Smith |
| 2,066,495 | A | | 1/1937 | Swift |
| 2,079,328 | A | | 5/1937 | McBean |
| 2,128,196 | A | | 8/1938 | Max |
| 2,248,578 | A | | 7/1941 | Moore |
| 2,260,064 | A | | 10/1941 | Stokes |
| 2,320,143 | A | | 5/1943 | Johnson |
| 2,321,042 | A | | 6/1943 | Preis |
| 2,330,015 | A | | 9/1943 | Stokes |
| 2,475,236 | A | | 7/1949 | Matthew |
| 2,554,160 | A | | 5/1951 | Von |
| 2,605,897 | A | | 8/1952 | Rundle |
| 2,684,807 | A | | 7/1954 | Gerrish |
| 2,719,647 | A | | 10/1955 | Freeman |
| 2,823,795 | A | | 2/1958 | Moore |
| 2,965,224 | A | | 12/1960 | Harwood |
| 3,080,238 | A | | 3/1963 | Howard |
| 3,127,273 | A | | 3/1964 | Monahan |
| 3,179,326 | A | | 4/1965 | Underwood |
| 3,186,628 | A | | 6/1965 | Rohde |
| 3,187,982 | A | | 6/1965 | Underwood |
| 3,217,871 | A | | 11/1965 | Lee |
| 3,235,165 | A | | 2/1966 | Jackson |
| 3,259,303 | A | | 7/1966 | Repko |
| 3,260,358 | A | | 7/1966 | Gottily |
| 3,272,422 | A | | 9/1966 | Miller |
| 3,291,377 | A | | 12/1966 | Eggen |
| 3,298,505 | A | | 1/1967 | Stephenson |
| 3,311,032 | A | | 3/1967 | Lucas |
| 3,326,450 | A | | 6/1967 | Langdon |
| 3,331,501 | A | | 7/1967 | Stewart |
| 3,343,541 | A | | 9/1967 | Bellamy |
| 3,373,922 | A | | 3/1968 | Watts |
| 3,373,926 | A | | 3/1968 | Voigtman |
| 3,454,210 | A | | 7/1969 | Spiegel |
| 3,471,005 | A | | 10/1969 | Sexstone |
| 3,528,825 | A | | 9/1970 | Doughty |
| 3,570,751 | A | | 3/1971 | Trewella |
| 3,595,466 | A | | 7/1971 | Rosenburg |
| 3,595,468 | A | | 7/1971 | Repko |
| 3,618,751 | A | | 11/1971 | Rich |
| 3,630,346 | A | | 12/1971 | Burnside |
| 3,651,615 | A | | 3/1972 | Bohner |
| 3,653,502 | A | | 4/1972 | Beaudoin |
| 3,687,352 | A | | 8/1972 | Kalajian |
| 3,740,238 | A | | 6/1973 | Graham |
| 3,757,078 | A | | 9/1973 | Conti |
| 3,790,744 | A | | 2/1974 | Bowen |
| 3,811,564 | A | | 5/1974 | Braber |
| 3,865,302 | A | | 2/1975 | Kane |
| 3,885,727 | A | | 5/1975 | Gilley |
| 3,905,646 | A | | 9/1975 | Brackmann |
| 3,909,582 | A | | 9/1975 | Bowen |
| 3,910,410 | A | | 10/1975 | Shaw |
| 3,938,659 | A | | 2/1976 | Wardwell |
| 3,966,046 | A | | 6/1976 | Deutschlander |
| 3,971,506 | A | | 7/1976 | Roenna |
| 4,082,216 | A | | 4/1978 | Clarke |
| 4,113,104 | A | | 9/1978 | Meyers |
| 4,140,046 | A | | 2/1979 | Marbach |
| 4,143,695 | A | | 3/1979 | Hoehn |
| 4,156,493 | A | | 5/1979 | Julius |
| 4,185,754 | A | | 1/1980 | Julius |
| 4,192,420 | A | | 3/1980 | Ross |
| 4,192,448 | A | | 3/1980 | Porth |
| 4,197,949 | A | | 4/1980 | Carlsson |
| 4,210,246 | A | | 7/1980 | Kuchenbecker |
| 4,258,876 | A | | 3/1981 | Ljungcrantz |
| 4,260,061 | A | | 4/1981 | Jacobs |
| 4,273,815 | A | | 6/1981 | Gifford |
| 4,285,681 | A | | 8/1981 | Walitalo |
| 4,306,367 | A | | 12/1981 | Otto |
| 4,337,862 | A | | 7/1982 | Suter |
| 4,364,478 | A | | 12/1982 | Tuens |
| 4,397,415 | A | | 8/1983 | Lisiecki |
| 4,411,365 | A | | 10/1983 | Horikawa |
| 4,420,080 | A | | 12/1983 | Nakamura |
| 4,428,477 | A | | 1/1984 | Cristofolo |
| 4,460,088 | A | | 7/1984 | Rugenstein |
| 4,464,154 | A | | 8/1984 | Ljungcrantz |
| 4,488,647 | A | | 12/1984 | Davis |
| 4,506,488 | A | | 3/1985 | Matt et al. |
| 4,518,087 | A | | 5/1985 | Goglio |
| 4,538,396 | A | | 9/1985 | Nakamura |
| 4,545,844 | A | | 10/1985 | Buchanan |
| 4,548,824 | A | | 10/1985 | Mitchell |
| 4,548,852 | A | | 10/1985 | Mitchell |
| 4,549,063 | A | | 10/1985 | Ang |
| 4,550,831 | A | | 11/1985 | Whitford |
| 4,552,269 | A | | 11/1985 | Chang |
| 4,557,505 | A | | 12/1985 | Schaefer |
| 4,570,820 | A | | 2/1986 | Murphy |
| 4,572,377 | A | | 2/1986 | Beckett |
| 4,608,288 | A | | 8/1986 | Spindler |
| 4,610,357 | A | | 9/1986 | Nakamura |
| 4,613,046 | A | | 9/1986 | Kuchenbecker |
| 4,616,470 | A | | 10/1986 | Nakamura |
| 4,625,495 | A | | 12/1986 | Holovach |
| 4,638,911 | A | | 1/1987 | Prohaska |
| 4,648,509 | A | | 3/1987 | Alves |
| 4,651,874 | A | | 3/1987 | Nakamura |
| 4,653,250 | A | | 3/1987 | Nakamura |
| 4,658,963 | A | | 4/1987 | Jud |
| 4,667,453 | A | | 5/1987 | Goglio |
| 4,671,453 | A | | 6/1987 | Cassidy |
| 4,673,085 | A | | 6/1987 | Badouard |
| 4,679,693 | A | * | 7/1987 | Forman ..... 383/203 |
| 4,694,960 | A | | 9/1987 | Phipps |
| 4,696,404 | A | | 9/1987 | Corella |
| 4,723,301 | A | | 2/1988 | Chang |
| 4,738,365 | A | * | 4/1988 | Prater ..... 229/123.3 |
| 4,739,879 | A | | 4/1988 | Nakamura |
| 4,770,325 | A | | 9/1988 | Gordon |
| 4,784,885 | A | | 11/1988 | Carespodi |
| 4,790,436 | A | | 12/1988 | Nakamura |
| 4,798,295 | A | | 1/1989 | Rausing |
| 4,798,296 | A | | 1/1989 | Lagerstedt |
| 4,799,594 | A | | 1/1989 | Blackman |
| 4,811,848 | A | | 3/1989 | Jud |
| 4,818,120 | A | | 4/1989 | Addiego |
| 4,838,429 | A | | 6/1989 | Fabisiewicz |
| 4,840,270 | A | | 6/1989 | Caputo |
| 4,845,470 | A | | 7/1989 | Boldt |
| 4,848,575 | A | | 7/1989 | Nakamura |
| 4,858,780 | A | | 8/1989 | Odaka et al. |
| 4,863,064 | A | | 9/1989 | Dailey |
| 4,865,198 | A | | 9/1989 | Butler |
| 4,866,911 | A | | 9/1989 | Grindrod |
| 4,874,096 | A | | 10/1989 | Tessera-Chiesa |
| 4,876,123 | A | | 10/1989 | Rivera |
| 4,889,731 | A | | 12/1989 | Williams |
| 4,901,505 | A | | 2/1990 | Williams, Jr. |
| 4,902,142 | A | | 2/1990 | Lammert |
| 4,917,247 | A | | 4/1990 | Jud |
| 4,943,439 | A | | 7/1990 | Andreas |
| 4,972,953 | A | | 11/1990 | Friedman |
| 4,998,666 | A | | 3/1991 | Ewan |
| 4,999,081 | A | | 3/1991 | Buchanan |
| 5,000,320 | A | | 3/1991 | Kuchenbecker |

(56) References Cited

U.S. PATENT DOCUMENTS

| | | | |
|---|---|---|---|
| 5,001,325 | A | 3/1991 | Huizinga |
| 5,005,264 | A | 4/1991 | Breen |
| 5,010,231 | A | 4/1991 | Huizinga |
| 5,018,625 | A | 5/1991 | Focke |
| 5,029,712 | A | 7/1991 | OBrien et al. |
| 5,040,685 | A | 8/1991 | Focke |
| 5,046,621 | A | 9/1991 | Bell |
| 5,048,718 | A | 9/1991 | Nakamura |
| 5,054,619 | A | 10/1991 | Muckenfuhs |
| 5,060,848 | A | 10/1991 | Ewan |
| 5,065,868 | A | 11/1991 | Cornelissen |
| 5,076,439 | A | 12/1991 | Kuchenbecker |
| 5,077,064 | A | 12/1991 | Hustad |
| 5,078,509 | A | 1/1992 | Center |
| 5,082,702 | A | 1/1992 | Alband |
| 5,085,724 | A | 2/1992 | Focke |
| 5,096,113 | A | 3/1992 | Focke |
| 5,100,003 | A | 3/1992 | Jud |
| 5,103,980 | A | 4/1992 | Kuchenbecker |
| 5,108,669 | A | 4/1992 | van Dijk et al. |
| 5,124,388 | A | 6/1992 | Pruett |
| 5,125,211 | A | 6/1992 | OBrien |
| 5,134,001 | A | 7/1992 | Osgood |
| 5,158,499 | A | 10/1992 | Guckenberger |
| 5,161,350 | A | 11/1992 | Nakamura |
| 5,167,455 | A | 12/1992 | Forman |
| 5,167,974 | A | 12/1992 | Grindrod |
| 5,174,659 | A | 12/1992 | Laske |
| 5,184,771 | A | 2/1993 | Jud |
| 5,190,152 | A | 3/1993 | Smith |
| 5,197,618 | A | 3/1993 | Goth |
| 5,222,422 | A | 6/1993 | Benner |
| 5,222,813 | A | 6/1993 | Kopp |
| 5,229,180 | A | 7/1993 | Littmann |
| 5,294,470 | A | 3/1994 | Ewan |
| 5,307,988 | A | 5/1994 | Focke |
| 5,333,735 | A | 8/1994 | Focke |
| 5,344,007 | A | 9/1994 | Nakamura |
| 5,352,466 | A | 10/1994 | Delonis |
| 5,356,068 | A | 10/1994 | Moreno |
| 5,366,087 | A | 11/1994 | Bane |
| 5,371,997 | A | 12/1994 | Kopp |
| 5,374,179 | A | 12/1994 | Swanson |
| 5,375,698 | A | 12/1994 | Ewart |
| 5,381,643 | A | 1/1995 | Kazaitis |
| 5,382,190 | A | 1/1995 | Graves |
| 5,388,757 | A | 2/1995 | Lorenzen |
| 5,405,629 | A | 4/1995 | Marnocha |
| 5,407,070 | A | 4/1995 | Bascos |
| 5,409,115 | A | 4/1995 | Barkhorn |
| 5,409,116 | A | 4/1995 | Aronsen |
| 5,439,102 | A | 8/1995 | Brown |
| 5,454,207 | A | 10/1995 | Storandt |
| 5,460,838 | A | 10/1995 | Wermund |
| 5,460,844 | A | 10/1995 | Gaylor |
| 5,461,845 | A | 10/1995 | Yeager |
| 5,464,092 | A | 11/1995 | Seeley |
| 5,470,015 | A | 11/1995 | Jud |
| 5,489,060 | A | 2/1996 | Godard |
| 5,499,757 | A | 3/1996 | Back |
| 5,503,858 | A | 4/1996 | Reskow |
| 5,505,305 | A | 4/1996 | Scholz |
| 5,515,965 | A | 5/1996 | Boldrini |
| 5,519,982 | A | 5/1996 | Herber |
| 5,520,939 | A | 5/1996 | Wells |
| 5,524,759 | A | 6/1996 | Herzberg |
| 5,531,325 | A | 7/1996 | Deflander |
| 5,538,129 | A | 7/1996 | Chester |
| 5,550,346 | A | 8/1996 | Andriash |
| 5,558,438 | A | 9/1996 | Warr |
| 5,582,342 | A | 12/1996 | Jud |
| 5,582,853 | A | 12/1996 | Marnocha |
| 5,582,887 | A | 12/1996 | Etheredge |
| 5,591,468 | A | 1/1997 | Stockley |
| 5,630,308 | A | 5/1997 | Guckenberger |
| 5,633,058 | A | 5/1997 | Hoffer |
| 5,636,732 | A | 6/1997 | Gilels |
| 5,637,369 | A | 6/1997 | Stewart |
| 5,647,100 | A | 7/1997 | Porchia |
| 5,647,506 | A | 7/1997 | Julius |
| 5,664,677 | A | 9/1997 | OConnor |
| 5,688,394 | A | 11/1997 | McBride |
| 5,688,463 | A | 11/1997 | Robichaud |
| 5,702,743 | A | 12/1997 | Wells |
| 5,709,479 | A | 1/1998 | Bell |
| 5,725,311 | A | 3/1998 | Ponsi |
| D394,204 | S | 5/1998 | Seddon |
| D394,605 | S | 5/1998 | Skiba |
| 5,749,657 | A | 5/1998 | May |
| 5,770,283 | A | 6/1998 | Gosselin |
| 5,791,465 | A | 8/1998 | Niki |
| 5,795,604 | A | 8/1998 | Wells |
| 5,819,931 | A | 10/1998 | Boucher et al. |
| 5,820,953 | A | 10/1998 | Beer |
| 5,833,368 | A | 11/1998 | Kaufman |
| 5,855,435 | A | 1/1999 | Chiesa |
| 5,862,101 | A | 1/1999 | Haas |
| 5,873,483 | A | 2/1999 | Goertz |
| 5,873,607 | A | 2/1999 | Waggoner |
| 5,882,116 | A | 3/1999 | Backus |
| 5,885,673 | A | 3/1999 | Light |
| 5,906,278 | A | 5/1999 | Ponsi |
| 5,908,246 | A | 6/1999 | Arimura |
| 5,928,749 | A | 7/1999 | Forman |
| 5,938,013 | A | 8/1999 | Palumbo |
| 5,939,156 | A | 8/1999 | Rossi |
| 5,945,145 | A | 8/1999 | Narsutis |
| 5,956,794 | A | 9/1999 | Skiba |
| 5,993,962 | A | 11/1999 | Timm |
| 5,996,797 | A | 12/1999 | Flaig |
| 5,997,177 | A | 12/1999 | Kaufman |
| 6,006,907 | A | 12/1999 | Sato |
| 6,012,572 | A | 1/2000 | Heathcock |
| 6,015,934 | A | 1/2000 | Lee |
| 6,026,953 | A | 2/2000 | Nakamura |
| 6,028,289 | A | 2/2000 | Robichaud |
| 6,029,809 | A | 2/2000 | Skiba |
| 6,056,141 | A | 5/2000 | Navarini |
| 6,060,095 | A | 5/2000 | Scrimager |
| 6,065,591 | A | 5/2000 | Dill |
| 6,066,437 | A | 5/2000 | Kosslinger |
| 6,076,969 | A | 6/2000 | Jaisle |
| 6,077,551 | A | 6/2000 | Scrimager |
| 6,099,682 | A | 8/2000 | Krampe |
| 6,113,271 | A | 9/2000 | Scott |
| 6,125,614 | A | 10/2000 | Jones |
| 6,126,009 | A | 10/2000 | Shiffler |
| 6,126,317 | A | 10/2000 | Anderson |
| 6,152,601 | A | 11/2000 | Johnson |
| 6,164,441 | A | 12/2000 | Guy |
| 6,213,645 | B1 | 4/2001 | Beer |
| 6,228,450 | B1 | 5/2001 | Pedrini |
| D447,054 | S | 8/2001 | Hill |
| 6,273,610 | B1 | 8/2001 | Koyama |
| 6,279,297 | B1 | 8/2001 | Latronico |
| 6,296,884 | B1 | 10/2001 | Okerfund |
| 6,299,355 | B1 | 10/2001 | Schneck |
| 6,309,104 | B1 | 10/2001 | Koch |
| 6,309,105 | B1 | 10/2001 | Palumbo |
| 6,318,894 | B1 | 11/2001 | Derenthal |
| 6,352,364 | B1 | 3/2002 | Mobs |
| 6,364,113 | B1 | 4/2002 | Faasse |
| 6,365,255 | B1 | 4/2002 | Kittel |
| 6,383,592 | B1 | 5/2002 | Lowry |
| 6,402,379 | B1 | 6/2002 | Albright |
| 6,420,006 | B1 | 7/2002 | Scott |
| 6,427,420 | B1 | 8/2002 | Olivieri |
| 6,428,867 | B1 | 8/2002 | Scott |
| 6,446,811 | B1 | 9/2002 | Wilfong |
| 6,450,685 | B1 | 9/2002 | Scott |
| 6,457,585 | B1 | 10/2002 | Huffer |
| 6,461,043 | B1 | 10/2002 | Healy |
| 6,461,708 | B1 | 10/2002 | Dronzek |
| 6,471,817 | B1 | 10/2002 | Emmert |

(56) References Cited

U.S. PATENT DOCUMENTS 6,476,743 B1 11/2002 Brown
6,482,867 B1 11/2002 Kimura
6,502,986 B1 1/2003 Bensur
6,517,243 B2 2/2003 Huffer
6,519,918 B2 2/2003 Forman et al.
6,539,691 B2 4/2003 Beer
6,554,134 B1 4/2003 Guibert
6,563,082 B2 5/2003 Terada
6,589,622 B1 7/2003 Scott
6,592,260 B1 7/2003 Randall
6,594,872 B2 7/2003 Cisek
6,612,432 B2 9/2003 Motson
6,616,334 B2 9/2003 Faaborg
6,621,046 B2 9/2003 Kaji
6,669,046 B1 12/2003 Sawada
6,691,886 B1 2/2004 Berndt
6,698,928 B2 3/2004 Miller
6,726,054 B2 4/2004 Fagen
6,726,364 B2 4/2004 Perell
6,746,743 B2 6/2004 Knoerzer
6,750,423 B2 6/2004 Tanaka
6,767,604 B2 7/2004 Muir
6,815,634 B2 11/2004 Sonoda
6,852,947 B2 2/2005 Tanaka
6,865,860 B2 3/2005 Arakawa
6,889,483 B2 5/2005 Compton
6,918,532 B2 7/2005 Sierra-Gomez
6,929,400 B2 8/2005 Razeti
6,951,999 B2 10/2005 Monforton
6,969,196 B2 11/2005 Woodham
6,983,875 B2 1/2006 Emmott
7,007,423 B2 3/2006 Andersson
7,021,827 B2 4/2006 Compton
7,032,754 B2 4/2006 Kopecky
7,032,757 B2 4/2006 Richards
7,032,810 B2 4/2006 Benedetti et al.
7,040,810 B2 5/2006 Steele
7,048,441 B2 5/2006 Pape
7,051,877 B2 5/2006 Lin
7,165,888 B2 1/2007 Rodick
7,172,779 B2 2/2007 Castellanos
7,207,718 B2 4/2007 Machacek
7,207,719 B2 4/2007 Marbler
7,213,710 B2 5/2007 Cotert
7,228,968 B1 6/2007 Burgess
7,254,873 B2 8/2007 Stolmeier
7,261,468 B2 8/2007 Schneider
7,262,335 B2 8/2007 Motsch
7,302,783 B2 12/2007 Cotert
7,344,744 B2 * 3/2008 Sierra-Gomez et al. ..... 426/119
7,350,688 B2 4/2008 Sierra-Gomez
7,351,458 B2 4/2008 Leighton
7,352,591 B2 4/2008 Sugahara
7,371,008 B2 * 5/2008 Bonenfant ..... 383/5
7,404,487 B2 7/2008 Kumakura
7,422,142 B2 9/2008 Arippol
7,470,062 B2 12/2008 Moteki
7,475,781 B2 1/2009 Kobayashi
7,516,599 B2 4/2009 Doll
7,527,189 B2 5/2009 Billig
7,533,773 B2 5/2009 Aldridge
1,949,161 A1 10/2009 Burgess
7,600,641 B2 10/2009 Burgess
7,703,602 B2 4/2010 Saito
7,708,463 B2 5/2010 Sampaio Camacho
7,717,620 B2 * 5/2010 Hebert et al. ..... 383/203
7,740,923 B2 6/2010 Exner
7,744,517 B2 * 6/2010 Bonenfant ..... 493/223
7,758,484 B2 7/2010 Peterson
7,858,901 B2 12/2010 Krishnan
7,963,413 B2 * 6/2011 Sierra-Gomez et al. ... 220/256.1
2,588,409 A1 7/2011 Aldridge
7,971,718 B2 7/2011 Aldridge
2,621,788 A1 8/2011 Ryan
8,002,171 B2 8/2011 Ryan
8,002,941 B2 8/2011 Exner
8,029,428 B2 10/2011 Selle
8,038,349 B2 10/2011 Andersson
8,114,451 B2 * 2/2012 Sierra-Gomez et al. ..... 426/87
8,181,784 B2 5/2012 Bouthiette
8,240,546 B2 8/2012 Friebe
8,262,830 B2 * 9/2012 Hebert et al. ..... 156/268
8,262,832 B2 * 9/2012 Hebert et al. ..... 156/268
8,308,363 B2 * 11/2012 Vogt et al. ..... 383/5
8,408,792 B2 * 4/2013 Cole et al. ..... 383/203
8,506,165 B2 8/2013 Shinozaki
8,763,890 B2 7/2014 Clark
8,951,591 B2 2/2015 Vogt
2001/0000480 A1 4/2001 Stagg
2002/0000441 A1 1/2002 Redmond
2002/0068668 A1 6/2002 Chow
2003/0019780 A1 1/2003 Parodi
2003/0039412 A1 2/2003 Rodick
2003/0047695 A1 3/2003 Zik
2003/0051440 A1 3/2003 Chow
2003/0053720 A1 3/2003 Smith et al.
2003/0118255 A1 6/2003 Miller
2003/0127352 A1 7/2003 Buschkiel
2003/0170357 A1 9/2003 Garwood
2003/0183637 A1 10/2003 Zappa
2003/0183643 A1 10/2003 Fagen
2003/0210838 A1 11/2003 Steele
2003/0217946 A1 11/2003 Hsu
2003/0223656 A1 12/2003 Razeti
2004/0011677 A1 1/2004 Arakawa
2004/0035719 A1 2/2004 Ebbers
2004/0060974 A1 4/2004 Dacey
2004/0062838 A1 4/2004 Castellanos
2004/0067326 A1 4/2004 Knoerzer
2004/0083680 A1 5/2004 Compton
2004/0091184 A1 5/2004 Miller
2004/0112010 A1 6/2004 Richards
2004/0150221 A1 8/2004 Brown
2004/0175060 A1 9/2004 Woodham
2004/0180118 A1 9/2004 Renger
2004/0206637 A1 10/2004 Sierra-Gomez
2005/0000965 A1 1/2005 Boardman
2005/0031233 A1 2/2005 Varanese et al.
2005/0084186 A1 4/2005 Caris
2005/0116016 A1 6/2005 Lo Duca
2005/0117819 A1 6/2005 Kingsford
2005/0220371 A1 10/2005 Machacek
2005/0247764 A1 11/2005 Sierra-Gomez
2005/0276525 A1 * 12/2005 Hebert et al. ..... 383/203
2005/0276885 A1 12/2005 Bennett
2006/0018569 A1 1/2006 Bonenfant
2006/0066096 A1 3/2006 Kan
2006/0124494 A1 6/2006 Clark
2006/0144911 A1 7/2006 Sierra-Gomez
2006/0171611 A1 8/2006 Rapparini
2006/0199717 A1 9/2006 Marbler
2006/0251342 A1 11/2006 Forman
2006/0257056 A1 11/2006 Miyake
2006/0257599 A1 11/2006 Exner
2006/0283750 A1 12/2006 Villars
2006/0285779 A1 12/2006 Golas
2007/0023435 A1 2/2007 Sierra-Gomez
2007/0023436 A1 2/2007 Sierra-Gomez
2007/0095709 A1 5/2007 Saito
2007/0140600 A1 6/2007 Nowak
2007/0209959 A1 9/2007 Burgess
2007/0269142 A1 11/2007 Tyska
2007/0275133 A1 11/2007 Sierra-Gomez
2008/0013869 A1 1/2008 Forman
2008/0031555 A1 2/2008 Roberts
2008/0037911 A1 2/2008 Cole
2008/0041750 A1 2/2008 Kohlweyer
2008/0053861 A1 3/2008 Mellin
2008/0060751 A1 3/2008 Arrindell
2008/0063324 A1 3/2008 Bernard
2008/0063759 A1 3/2008 Raymond
2008/0063760 A1 3/2008 Raymond
2008/0131035 A1 6/2008 Rogers
2008/0135428 A1 6/2008 Tallier

(56) References Cited

U.S. PATENT DOCUMENTS

| | | | | |
|---|---|---|---|---|
| 2008/0152264 | A1 | 6/2008 | Pokusa | |
| 2008/0156861 | A1 | 7/2008 | Sierra-Gomez | |
| 2008/0159666 | A1 | 7/2008 | Exner | |
| 2008/0203141 | A1 | 8/2008 | Friebe | |
| 2008/0214376 | A1 | 9/2008 | Bonenfant | |
| 2008/0240627 | A1 | 10/2008 | Cole | |
| 2008/0273821 | A1 | 11/2008 | Doll | |
| 2008/0292225 | A1 | 11/2008 | Dayrit | |
| 2009/0001143 | A1 | 1/2009 | Cowan | |
| 2009/0014491 | A1 | 1/2009 | Fuisz | |
| 2009/0022431 | A1 | 1/2009 | Conner | |
| 2009/0028472 | A1 | 1/2009 | Andersson | |
| 2009/0053372 | A1 | 2/2009 | Harnbrick | |
| 2009/0074333 | A1 | 3/2009 | Griebel | |
| 2009/0097786 | A1 | 4/2009 | Goglio | |
| 2009/0161995 | A1 | 6/2009 | Henderson et al. | |
| 2009/0190866 | A1 | 7/2009 | Hughes | |
| 2009/0211938 | A1 | 8/2009 | Aldridge | |
| 2009/0226117 | A1* | 9/2009 | Davis et al. | 383/5 |
| 2009/0273179 | A1 | 11/2009 | Scott | |
| 2010/0002963 | A1* | 1/2010 | Holbert et al. | 383/204 |
| 2010/0018974 | A1* | 1/2010 | Lyzenga et al. | 220/214 |
| 2010/0019022 | A1 | 1/2010 | Ryan | |
| 2010/0111453 | A1 | 5/2010 | Dierl | |
| 2010/0113241 | A1* | 5/2010 | Hebert et al. | 493/213 |
| 2010/0147724 | A1 | 6/2010 | Mitra-Shah | |
| 2010/0172604 | A1 | 7/2010 | Andersson | |
| 2010/0226598 | A1 | 9/2010 | Stoeppelmann | |
| 2010/0230303 | A1 | 9/2010 | Buse | |
| 2010/0278454 | A1* | 11/2010 | Huffer | 383/5 |
| 2010/0303391 | A9 | 12/2010 | Cole | |
| 2011/0049158 | A1 | 3/2011 | Bouthiette | |
| 2011/0127319 | A1 | 6/2011 | Golden | |
| 2011/0132976 | A1 | 6/2011 | Drenowski | |
| 2011/0147443 | A1 | 6/2011 | Igo | |
| 2011/0204056 | A1 | 8/2011 | Veternik et al. | |
| 2011/0253718 | A1 | 10/2011 | Sierra-Gomez et al. | |
| 2012/0125932 | A1 | 5/2012 | Sierra-Gomez | |
| 2012/0128835 | A1 | 5/2012 | Lyzenga et al. | |
| 2012/0177307 | A1* | 7/2012 | Duan et al. | 383/211 |
| 2013/0004626 | A1 | 1/2013 | Renders et al. | |
| 2013/0011527 | A1 | 1/2013 | Renders et al. | |
| 2013/0064477 | A1 | 3/2013 | Vogt et al. | |
| 2013/0114918 | A1 | 5/2013 | Lyzenga et al. | |
| 2014/0185965 | A1 | 7/2014 | Lyzenga | |
| 2014/0270597 | A1 | 9/2014 | Friedman | |
| 2015/0016756 | A1 | 1/2015 | Down | |
| 2015/0021219 | A1 | 1/2015 | SeyfferthDeOliveira | |

FOREIGN PATENT DOCUMENTS

| | | | | |
|---|---|---|---|---|
| BR | 62020307 | | 4/2003 | |
| BR | 68046367 | | 10/2009 | |
| CN | 1224396 | A | 7/1999 | |
| CN | 1781819 | A | 6/2006 | |
| DE | 1848870 | | 3/1962 | |
| DE | 3700988 | A1 | 7/1988 | |
| DE | 3835721 | A1 | 5/1990 | |
| DE | 9003401 | | 5/1990 | |
| DE | 9005297 | | 8/1990 | |
| DE | 9014065 | | 2/1991 | |
| DE | 4134567 | | 1/1993 | |
| DE | 4241423 | | 6/1994 | |
| DE | 19738411 | | 3/1999 | |
| DE | 19822328 | A1 | 11/1999 | |
| DE | 202004012301 | | 12/2004 | |
| DE | 20122333 | | 3/2005 | |
| DE | 202007005487 | | 6/2007 | |
| DE | 102007030267 | A1 | 1/2009 | |
| DE | 102010019867 | A1 | 9/2011 | |
| EP | 0085289 | | 8/1983 | |
| EP | 0307924 | A2 | 3/1989 | |
| EP | 0388310 | | 9/1990 | |
| EP | 408831 | A1 * | 1/1991 | B65D 17/32 |
| EP | 0447636 | | 9/1991 | |
| EP | 0474981 | | 3/1992 | |
| EP | 0488967 | | 6/1992 | |
| EP | 0546369 | | 6/1993 | |
| EP | 0608909 | | 8/1994 | |
| EP | 0613824 | | 9/1994 | |
| EP | 0629561 | A2 | 12/1994 | |
| EP | 0661154 | | 7/1995 | |
| EP | 0669204 | B2 | 8/1995 | |
| EP | 0744357 | | 11/1996 | |
| EP | 0752375 | | 1/1997 | |
| EP | 0758993 | | 2/1997 | |
| EP | 0796208 | | 9/1997 | |
| EP | 0905048 | A | 3/1999 | |
| EP | 1046594 | | 10/2000 | |
| EP | 1056066 | | 11/2000 | |
| EP | 1086906 | A2 | 3/2001 | |
| EP | 1136379 | | 9/2001 | |
| EP | 1288139 | | 3/2003 | |
| EP | 1318081 | A1 | 6/2003 | |
| EP | 1350741 | | 10/2003 | |
| EP | 1375380 | A1 | 1/2004 | |
| EP | 1382543 | A2 | 1/2004 | |
| EP | 1437311 | A1 | 7/2004 | |
| EP | 1449789 | A1 * | 8/2004 | B65D 77/20 |
| EP | 1457424 | | 9/2004 | |
| EP | 1468936 | | 10/2004 | |
| EP | 1477425 | A1 | 11/2004 | |
| EP | 1488936 | | 12/2004 | |
| EP | 1608567 | | 12/2005 | |
| EP | 1609737 | | 12/2005 | |
| EP | 1619137 | A1 | 1/2006 | |
| EP | 1637472 | A1 | 3/2006 | |
| EP | 1712468 | | 10/2006 | |
| EP | 1712488 | A1 | 10/2006 | |
| EP | 1755980 | | 2/2007 | |
| EP | 1760006 | A1 | 3/2007 | |
| EP | 1770025 | | 4/2007 | |
| EP | 1846306 | | 10/2007 | |
| EP | 1858776 | | 11/2007 | |
| EP | 1873082 | A1 | 1/2008 | |
| EP | 1908696 | | 4/2008 | |
| EP | 1939107 | | 7/2008 | |
| EP | 1975081 | A1 | 10/2008 | |
| EP | 2033910 | | 3/2009 | |
| EP | 2189506 | | 5/2010 | |
| FR | 1327914 | A | 5/1963 | |
| FR | 2674509 | | 10/1992 | |
| FR | 2693988 | | 1/1994 | |
| FR | 2766794 | | 2/1999 | |
| FR | 2783512 | | 3/2000 | |
| GB | 1107200 | | 3/1968 | |
| GB | 2171077 | | 8/1986 | |
| GB | 2266513 | | 11/1993 | |
| GB | 2276095 | A | 9/1994 | |
| JP | 57163658 | | 10/1982 | |
| JP | S5822411 | B2 | 5/1983 | |
| JP | 6080405 | | 5/1985 | |
| JP | 62171479 | | 10/1987 | |
| JP | 63022370 | | 1/1988 | |
| JP | 01167084 | A | 6/1989 | |
| JP | 01226579 | A | 9/1989 | |
| JP | 01267182 | A | 10/1989 | |
| JP | H11343468 | | 12/1990 | |
| JP | H0581083 | | 11/1993 | |
| JP | 09142551 | A | 6/1997 | |
| JP | 9150872 | | 6/1997 | |
| JP | H09156677 | A | 6/1997 | |
| JP | 10059441 | | 3/1998 | |
| JP | 10129685 | | 5/1998 | |
| JP | H10152179 | A | 9/1998 | |
| JP | 10120016 | | 12/1998 | |
| JP | 11198977 | | 7/1999 | |
| JP | 2000335542 | A | 12/2000 | |
| JP | 2001114357 | | 4/2001 | |
| JP | 2001301807 | | 10/2001 | |
| JP | 2002002805 | A | 1/2002 | |
| JP | 2002104550 | A | 4/2002 | |
| JP | 200326224 | | 1/2003 | |

(56) References Cited

FOREIGN PATENT DOCUMENTS

| | | | | |
|---|---|---|---|---|
| JP | 2003026224 | | 1/2003 | |
| JP | 2003072774 | | 3/2003 | |
| JP | 2003137314 | | 5/2003 | |
| JP | 2005015015 | | 1/2005 | |
| JP | 200602767 | | 2/2006 | |
| JP | 2006062712 | | 3/2006 | |
| JP | 2006137445 | A | 6/2006 | |
| JP | 2007045434 | | 2/2007 | |
| JP | 2009166870 | | 7/2009 | |
| WO | 8606350 | | 11/1986 | |
| WO | 9104920 | | 4/1991 | |
| WO | 9411270 | A1 | 5/1994 | |
| WO | 9532902 | | 12/1995 | |
| WO | 9725200 | | 7/1997 | |
| WO | 0064755 | | 11/2000 | |
| WO | 0140073 | A1 | 6/2001 | |
| WO | 02064365 | A1 | 8/2002 | |
| WO | 02066341 | | 8/2002 | |
| WO | 03013976 | A1 | 2/2003 | |
| WO | 03035504 | | 5/2003 | |
| WO | 03037727 | | 5/2003 | |
| WO | 03059776 | A1 | 7/2003 | |
| WO | 2004087527 | A1 | 10/2004 | |
| WO | 2005054079 | | 6/2005 | |
| WO | 2005056420 | | 6/2005 | |
| WO | 2005110042 | | 11/2005 | |
| WO | 2005110865 | | 11/2005 | |
| WO | 2005110876 | | 11/2005 | |
| WO | 2005110885 | A2 | 11/2005 | |
| WO | 2005120989 | | 12/2005 | |
| WO | 2005123535 | A1 | 12/2005 | |
| WO | 2006055128 | A2 | 5/2006 | |
| WO | 2006080405 | | 8/2006 | |
| WO | 2006108614 | | 10/2006 | |
| WO | 2007090419 | | 8/2007 | |
| WO | 2008051813 | | 5/2008 | |
| WO | 2008062159 | A1 | 5/2008 | |
| WO | 2008074060 | | 6/2008 | |
| WO | 2008108969 | | 9/2008 | |
| WO | WO 2008115693 | A1 * | 9/2008 | ..... B31B 19/14 |
| WO | 2008122961 | | 10/2008 | |
| WO | 2008146142 | | 12/2008 | |
| WO | 2009065120 | | 5/2009 | |
| WO | 2009111153 | | 9/2009 | |
| WO | 2010002834 | | 1/2010 | |
| WO | 2010046623 | | 4/2010 | |
| WO | 2010080810 | | 7/2010 | |
| WO | 2010084336 | A1 | 7/2010 | |
| WO | 2010088492 | A1 | 8/2010 | |
| WO | 2010114879 | A1 | 10/2010 | |
| WO | 2010149996 | A1 | 12/2010 | |
| WO | 2011004156 | A2 | 1/2011 | |
| WO | 2011121337 | A2 | 10/2011 | |

OTHER PUBLICATIONS

'Elite Edam Cheese', Mintel gnpd, Dec. 3, 2001, Mintel Publishing, 2 pages.

'Margin.' Merriam-Webster Online Dictionary. 2010. Merriam-Webster [online], retrieved on May 6, 2010, Retrieved from the internet:URL: http://www.merriam-webster.com/dictionary/margin, 3 pages.

'New Easy Peel Cheese Packaging', Mintel gnpd, Aug. 10, 2001, Mintel Publishing.

'New on the Shelf-Product Instructions and Packaging Trends', Circle Reader Service Card No. 93, Aug. 1998, Baking & Snack.

'Soft Bread Sticks', Mintel gnpd, Mar. 20, 1998, Mintel Publishing, 1 page.

"Wall's Bacon A Sizzling Success Story" and The Grocer: "When sealed delivers", the second page of which bears a date of Aug. 21, 1999.

Defendants' Final Invalidity Contentions—Exhibit A-1, dated Sep. 27, 2013, 55 pages.

Defendants' Final Invalidity Contentions—Exhibit A-2, dated Sep. 27, 2013, 35 pages.

Defendants' Final Invalidity Contentions—Exhibit A-3, dated Sep. 27, 2013, 34 pages.

Defendants' Final Invalidity Contentions—Exhibit A-4, dated Sep. 27, 2013, 35 pages.

Defendants' Final Invalidity Contentions—Exhibit B-1, dated Sep. 27, 2013, 135 pages.

Defendants' Final Invalidity Contentions—Exhibit B-2, dated Sep. 27, 2013, 64 pages.

Defendants' Final Invalidity Contentions—Exhibit B-3, dated Sep. 27, 2013, 140 pages.

Defendants' Final Invalidity Contentions—Exhibit B-4, dated Sep. 27, 2013, 273 pages.

Defendants' Final Invalidity Contentions—Exhibit B-5, dated Sep. 27, 2013, 146 pages.

Defendants' Final Invalidity Contentions—Exhibit B-6, dated Sep. 27, 2013, 226 pages.

Defendants' Final Invalidity Contentions Pursuant to LPR 3.1, dated Sep. 27, 2013, 22 pages.

Defendants' Final Unenforceability Contentions Pursuant to LPR 3.1, dated Sep. 27, 2013, 14 pages.

Defendants' Initial Non-Infringement Contentions Pursuant to LPR 2.3(a), dated May 17, 2013, 7 pages.

Defendants' Invalidity Contentions—Exhibit A-1, dated May 17, 2013, 55 pages.

Defendants' Invalidity Contentions—Exhibit A-2, dated May 17, 2013, 35 pages.

Defendants' Invalidity Contentions—Exhibit A-3, dated May 17, 2013, 34 pages.

Defendants' Invalidity Contentions—Exhibit A-4, dated May 17, 2013, 35 pages.

Defendants' invalidity Contentions—Exhibit A-5, dated May 17, 2013, 39 pages.

Defendants' Invalidity Contentions Pursuant to LPR 2.3, dated May 17, 2013, 23 pages.

Defendants' LPR 2.3 Initial Non-Infringement Contentions Exhibit A, dated May 17, 2013, 39 pages.

Defendants' Unenforceability Contentions Pursuant to LPR 2.3, dated May 17, 2013, 13 pages.

Defendants' Answer, Affirmative Defenses, and Counterclaims Responsive to Complaint, dated Apr. 5, 2012, 25 pages.

English Transiation of JP H09-158677 published on Jun. 17, 1997, 2 pages.

English Translation of Japanese Official Notice of Rejection mailed on Feb. 14, 2012 in JP Application No. 2009-172352, 3 pages.

English Translation of JP 1998-152179 (H10-152179 A), published on Sep. 6, 1998, 6 pages.

English Translation of JP 2001-114357 published on Apr. 24, 2001, 8 pages.

English Translation of JP 2003-26224 published on Jan. 29, 2003, 13 pages.

English Translation of JP H09-156677 published Jun. 17, 1995; 8 pgs.

English Translation of JP Official Notice of Rejection mailed on Jan. 29, 2013 in JP Appl. No. 2008-087152 citing JPH0581083, 5 pages.

European Packaging Pack Report, NR. May 5, 2001 and partial translation thereof, 6 pages.

European Search Report, EP10305289 citing DE1848870U, 3 pages.

European Search Report 06118142.6 dated May 3, 2007, citing DE90140656, 10 pages.

Fuji Packaging GmbH Fachpack brochure, Oct. 11-12, 2001; 2 pgs.

Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.

Global Brands' LPR 2.5 Initial Response to Defendants' Initial Invalidity Contentions Chart Ex. A-1, dated May 31, 2013, 30 pages.

Global Brands' LPR 2.5 Initial Response to Defendants' Initial Invalidity Contentions Chart Ex. A-2, dated May 31, 2013, 20 pages.

Global Brands' LPR 2.5 Initial Response to Defendants' Initial Invalidity Contentions Chart Ex. A-3, dated May 31, 2013, 21 pages.

(56) References Cited

OTHER PUBLICATIONS

Global Brands' LPR 2.5 Initial Response to Defendants' Initial Invalidity Contentions Chart Ex. A-5, dated May 31, 2013, 14 pages.
Global Brands LPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Machine translation of claim for BR 5500885-2 from Googletranslate.com; 1 pg.
Machine translation of claim for BR 6202030-7 from Googletranslate.com; 1 pg.
Machine translation of claim for BR 6804636-7 from Googletranslate.com; 1 pg.
Machine translation of DE 202007005487, published Jun. 14, 2007, provided by Espacenet, 3 pages.
Machine translation of DE9014065, published Mar. 19, 2009, provided by Espacenet, 9 pages.
Machinery Update, Mar./Apr. 2002, pp. 56-62.
Machinery Update, Sep./Oct. 2001, pp. 46-47.
Opposition to EP1679269 filed by Awapatent AB, Heisingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, citing DE9003401 and DE9005297, 9 pages.
Plaintiff's Initial Response to Defendant's Initial Invalidity Contentions, dated May 31, 2013, 20 pages.
Reseal-lt. Web page Internet print out accessed Mar. 14, 2005; 19 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Defendants' Supplemental Memorandum of Law Regarding Additional Claim Construction Authority Requested by the Court, dated Feb. 28, 2014, 13 pages.
English Translation of Japanese Unexamined Application Publication No. H9-156677, published Jul. 17, 1997; 6 pages.
Kellogg's Opening Claim Construction Brief, dated Dec. 13, 2013, 30 pages.
Kellogg's Reply Claim Construction Brief, dated Jan. 24, 2014, 19 pages.
Kellogg's Response to Plaintiff's Surreply Claim Construction Brief Pursuant to Docket No. 98, dated Feb. 28, 2014, 9 pages.
Machine translation of CN 1781819A published Jun. 7, 2006 from google.com/patents; 13 pages, accessed Jun. 5, 2014.
Plaintiff Intercontinental Great Brands LLC's Responsive Claim Construction Brief Pursuant to LPR 4.2, dated Feb. 10, 2014, 27 pages.
Plaintiff Intercontinental Great Brands LLC's Submission of Authority Pursuant to Docket No. 98, dated Feb. 28, 2014, 11 pages.
Plaintiff Intercontinental Great Brands LLC's Surreply Claim Construction Brief Pursuant to Docket No. 98, dated Feb. 21, 2014, 6 pages.
U.S. District Court for the Northern District of Illinois, Eastern Division Memorandum Opinion and Order, dated Sep. 22, 2014, 12 pages.
Additional Exhibits from Declaration of James Lukas Jr. filed Mar. 26, 2015, 73 pages.
Declaration of James J. Lukas, Jr. in Support of Defendants' Motion for Summary Judgment with Exhibits, Part 1 dated Mar. 23, 2015, 277 pages.
Declaration of James J. Lukas, Jr. in Support of Defendants' Opposition to Plaintiff's Motions for Summary Judgment with Exhibits (redacted), dated May 28, 2015, 228 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Declaration of Katie Crosby Lehmann in Support of Plaintiff's Reply in Support of its Motions for Summary Judgment and Exhibit (unsealed), dated Jun. 10, 2015, 8 pages.
Defendants' Consolidated Memorandum in Support of Motion for Summary Judgment (redacted) with Exhibits A-G, dated Mar. 23, 2015, 166 pages.
Defendants' Consolidated Reply in Support of Defendants' Motion for Summary Judgment with Exhibits, dated May 28, 2015, 36 pages.
Defendants' Local Rule 56.1 Statement of Material Facts in Support of Motion for Summary Judgment, dated Mar. 23, 2015, 75 pages.
Defendants' Local Rule 56.1 Statement of Material Facts in Support of Motion for Summary Judgment (redacted), dated Mar. 23, 2015, 75 pages.
Defendants' LR 56.1 (b) (3) (C) Statement of Additional Material Facts in Support of Their Opposition to Plaintiff's Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Memorandum in Support of Their Motion to Compel Discovery, dated Oct. 13, 2014, 13 pages.
Defendants' Motion for Summary Judgment of Non-Infringement and Motion for Summary Judgment of Invalidity Under 35 U.S.C. 102 and/or 103, dated Mar. 23, 2015, 4 pages.
Defendants' Motion to Compel Discovery, dated Oct. 13, 2014, 3 pages.
Defendants' Response to Plaintiff's Local Rule 56.1 Statement of Material Facts in Support of Plaintiff's Motions for Summary Judgment, dated May 28, 2015, 108 pages.
Exhibits, part 2, to Declaration of James J. Lukas, Jr. in Support of Defendants' Motion for Summary Judgment, dated Mar. 23, 2015 125 pages.
Exhibits, part 2, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 3, to Declaration of James J. Lukas, Jr. in Support of Defendants' Motion for Summary Judgment, dated Mar. 23, 2015, 125 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4, to Declaration of James J. Lukas, Jr. in Support of Defendants' Motion for Summary Judgment with Exhibits, dated Mar. 23, 2015, 28 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted),dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted),dated May 8, 2015, 136 pages.
Exhibits from Defendants' Memorandum in Support of Their Motion to Compel Discovery, dated Oct. 13, 2014, 68 pages.
Exhibits from Plaintiff's Memorandum of Law in Opposition to Defendants' Motion to Compel Discovery, Oct. 15, 2014, 78 pages.

(56) References Cited

OTHER PUBLICATIONS

Plaintiff's Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Memorandum of Law in Opposition to Defendants' Motion to Compel Discovery, Oct. 15, 2014, 12 pages.
Plaintiff's Reply in Support of its Motions for Summary Judgment, dated Jun. 1, 2015, 19 pages.
Machine Translation of EP 1449789 description. Translated on Jun. 13, 2015, 18 pages.
U.S. District Court for the Northern District of Illinois, Eastern Division, Memorandum Opinion and Order, dated Aug. 3, 2015, 37 pages.
English Translation of JP2002-002805 filed by Onuma, published Sep. 1, 2012, translation provided by the U.S. Appl. No. 11/193,614.

* cited by examiner

PACKAGE INTEGRITY INDICATING CLOSURE

CROSS-REFERENCE TO RELATED APPLICATION

This application is a continuation of U.S. patent application Ser. No. 11/693,751, filed Mar. 30, 2007, which is hereby incorporated by reference in its entirety.

FIELD OF THE INVENTION

The present invention relates to a resealable closure for packages storing articles and, more particularly, such resealable closures having a package integrity indicator.

BACKGROUND OF THE INVENTION

Some containers for food products, such as cookies and other snacks, typically include an outer wrapper. In one type of container, the wrapper surrounds a frame which acts as a tray to hold the food product and to protect the food product from damage. Other food products come packaged in plastic trays, such as thermoform trays which are sealed on the top using some type of lidding material. One recent advancement in the art of food container closures includes a resealable closure disclosed in U.S. Pat. No. 6,918,532 (hereinafter the '532 patent), herein incorporated by reference, which discloses a wrapper which forms a top of the container, which top has an access opening covered by a resealable sealing panel.

In the packaging art, different structures have been used to indicate whether a package has been previously opened or whether the integrity of the package has been compromised, which structures are often referred to in the art as "tamper-evident." For example, one recent package integrity indicating closure is disclosed in U.S. patent application Ser. No. 11/500,497 hereinafter the '497 application and incorporated by reference, which shows a closure comprising a two-ply material having an inner film layer and an outer film layer forming a top of a container. The outer film layer has a sealing panel covering a portion of the inner film layer which, with the sealing panel, forms an opening. The package integrity feature comprises a panel of the inner film layer which separates from the sealing panel to indicate that the closure has been previously opened.

There is a need for improvement in the art of package integrity indicators for a resealable closure, preferably suitable for use with a resealable closure for containers or packages containing food items.

SUMMARY OF THE INVENTION

The present invention generally relates to a resealable closure for a container in which package integrity is indicated by a frangible or breakable structure which breaks and/or produces an audible sound when the resealable closure is opened for a first time.

The present invention, in one form, comprises a package integrity feature having a structure associated with a resealable closure. The structure preferably produces an audible sound when the resealable closure is opened for a first time. In one form, the structure comprises at least one strip initially affixed to a stationary and a movable portion of the resealable closure so that upon opening the resealable closure for a first time, at least one of the strips breaks, preferably producing the audible sound. The strips may include a weakened portion such as a narrowing at one location along its length. Integrity of the package is indicated by an intact strip viewable upon opening the resealable closure and conversely, a broken or non-intact strip would indicate that the resealable closure has been previously opened.

In a further form, package integrity is evidenced by a see-through window in the resealable closure so that a portion is visible therethrough prior to the closure being opened for a first time, but not visible therethrough after the closure has been opened for a first time and resealed. This portion may be one of the strips or it may be a second panel which is separate from the strips.

In another further form, the structure comprises at least two strips, wherein at least one strip will break at a different time than another one or more strips upon opening the resealable closure, thereby preferably producing at least two separate audible sounds as each strip breaks.

The package integrity feature may comprise a closure for a package having a top, an access opening in the top and a sealing panel which covers the access opening and sealingly engages the top around the access opening so as to originally seal the package and then, after having been opened a first time, be resealable against the top. A structure is associated with the resealable closure which preferably produces an audible sound when the resealable closure is opened for a first time. Advantageously, the structure produces an audible sound prior to being able to remove an item contained within the package.

The present invention, in another form, relates to a package integrity indicating closure comprising a film layer forming the top of a container and having a flap defining an access opening to gain access to the contents of the container and having at least one strip joining the flap to a remaining portion of the top. A sealing panel completely covers the flap including the at least one strip of the film layer. A releasable adhesive provided on either or both the sealing panel or on the film layer adheres the sealing panel to the film layer. The sealing panel is releasable from the film layer by pulling the sealing panel back in a peeling direction and is reclosable against the top to seal the access opening when the sealing panel is moved back against the top. Upon peeling the sealing panel back for a first time, the at least one strip joining the flap to the top breaks.

The package integrity indicating closure may also comprise at least a two-ply material comprising an inner layer adhesively joined to an outer layer and, together, forming a top of the container. The inner layer has a first panel, a second panel, and at least one strip joining the first panel to a remaining portion of the top of the container. The outer layer has a sealing panel formed therein which completely covers the first panel, covers the strip and covers the second panel of the inner layer. The first panel and the sealing panel are permanently joined to each other to provide an access opening into the container. A releasable adhesive provided around a perimeter of the sealing panel adheres the sealing panel to the inner layer and the second panel. The sealing panel is releasable from the inner layer and is separable from the second panel by pulling the sealing panel back in a peeling direction and reclosable against the top to seal the opening when the sealing panel is moved back against the top. Upon opening the closure for a first time, the at least one strip between the first panel and the remaining portion of the top of the container breaks. After closing, the second panel is separated from the sealing panel. Advantageously, in one form, the at least one strip is integrally formed with the inner layer.

Package integrity may also be indicated by misalignment of sealing panel holes with tab portions after the sealing panel has been opened and resealed.

Food items disposed in the container may include but are not limited to cookies, crackers, peanuts, cheese, sliced meats, and semi-solid foods.

Other features and advantages of the present invention are stated in or apparent from detailed descriptions of the presently preferred embodiments of the invention found herebelow.

DETAILED DESCRIPTION

Figure 1:
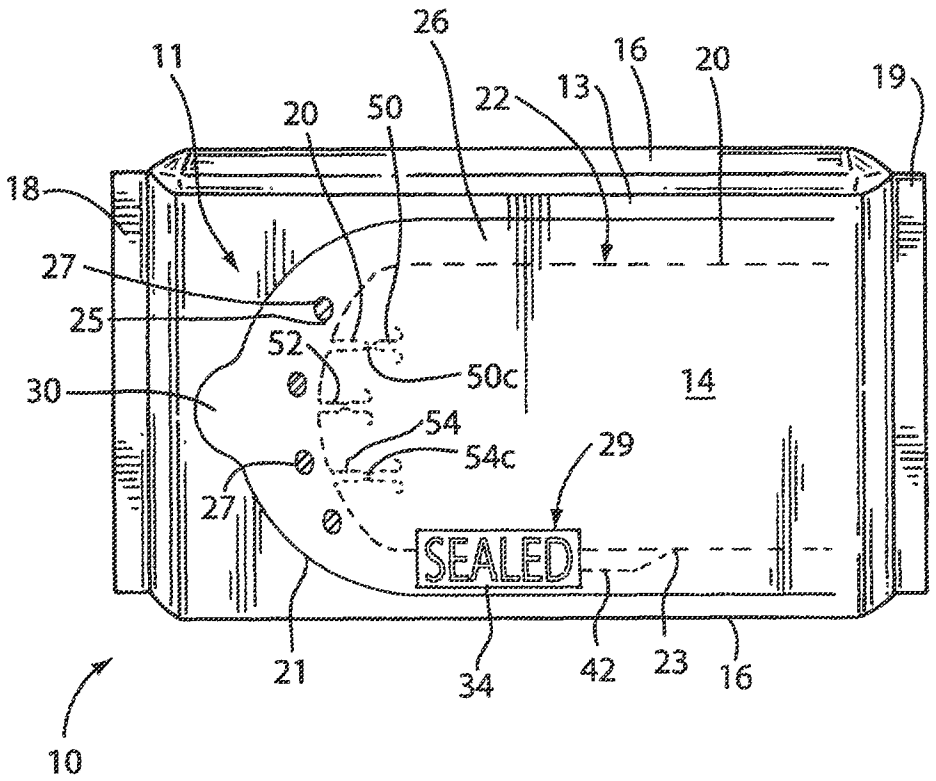
FIG. 1 is a perspective view of a package including an exemplary closure prior to an initial opening, according to the present invention.

Referring to the figures and, in particular, FIGS. 1-4, there is shown package 10 with closure 11, which incorporates a package integrity feature. Package 10 includes a two-ply wrapper comprising a first, inner film layer 12 and a second, outer film layer 13, forming a top or upper surface 14, sides 16, lower surface (not shown), and crimped ends 18, 19. The inner film layer 12 and outer film layer 13 are formed from a polymeric film or other flexible material that has been cut, folded or otherwise pressed to define an inner space or receptacle for receiving the desired product, such as food items, to be provided within the package 10. Package 10 can be used to store and distribute food items such as cookies, crackers, candy or other items. The outer film layer 13 may include graphics or other indicia to identify the contents of the package 10.

Advantageously, the inner film layer 12 is coextensively formed and adhesively joined to the outer film layer 13. During the manufacturing of the package 10, the first, inner film layer 12 is die cut on its side via first tear line 20, which includes all of the dashed lines in FIG. 1, other than second tear line 23. Outer film layer 13 is die cut on its side via a third tear line 21 and die cuts 25. Inner and outer tear lines are disclosed in U.S. Patent Application Publication No. 2005/0276525, herein incorporated by reference.

The first tear line 20 is formed as a continuous tear line to define a first panel 22. The first tear line 20 also defines a plurality of strips 50, 52, 54. A second tear line 23 forms a second panel 42 which also serves to indicate package integrity.

Figure 2A:
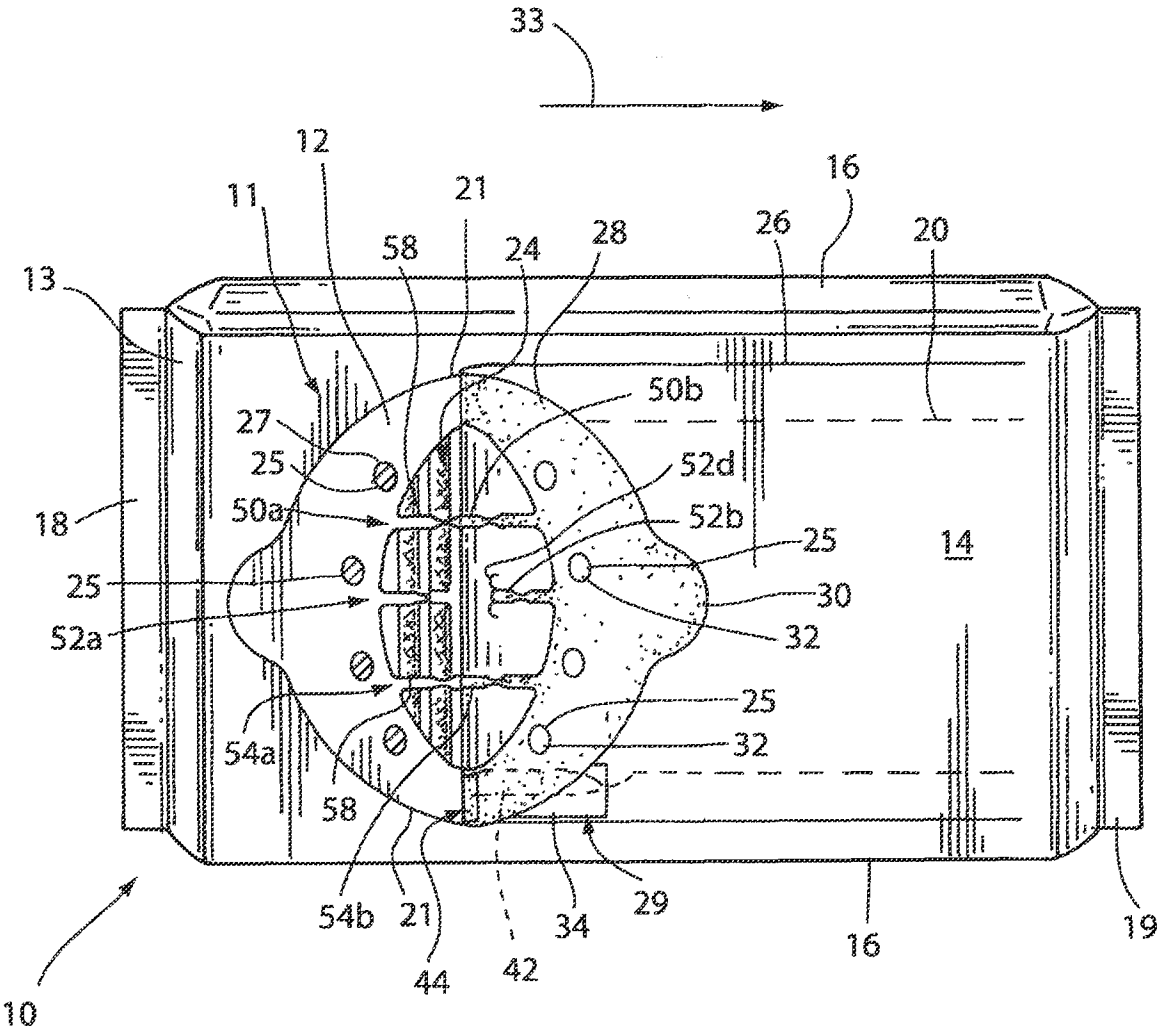
FIG. 2*a* is the package of FIG. 1, shown in a first partially opened condition.
Figure 2B:
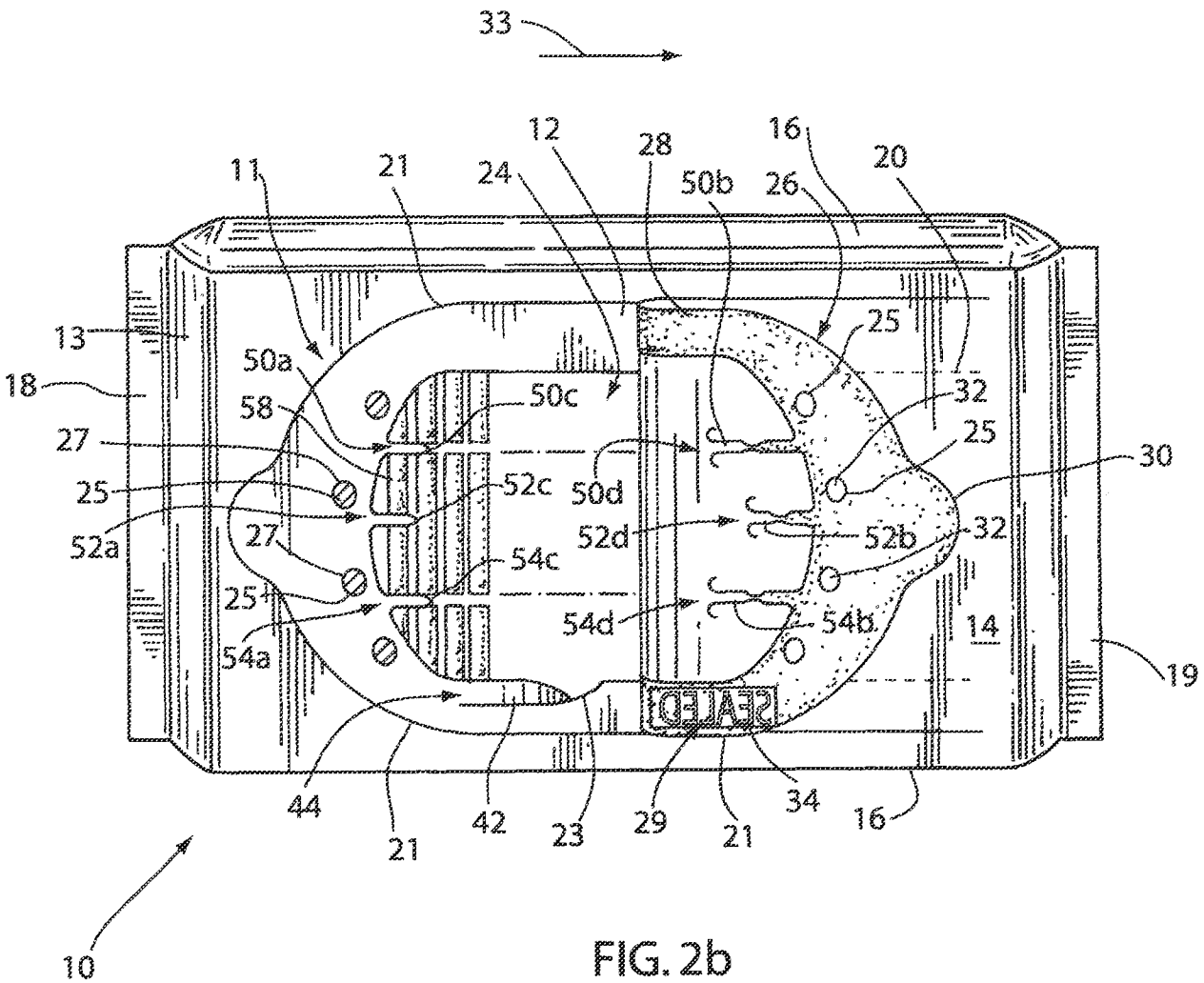
FIG. 2*b* is the package of FIG. 1, shown in a further partially opened condition relative to that of FIG. 2*a;*

The first panel 22 can be separated from the remainder of the inner film 12 to expose an opening 24 whereby access to the contents of the package may be gained after the strips 50, 52, 54 have broken (FIG. 2*a*, 2*b*). Each strip 50, 52, 54 is integrally joined, and remains attached to the remaining portion of the inner layer 12 which comprises the top 14 at strip portions 50*a*, 52*a*, 54*a*, respectively, and a portion of the strips 50, 52, 54 remains integrally attached to the first panel 22 at strip portions 50*b*, 52*b*, 54*b*, respectively. Each strip 50, 52, 54 has a weakened portion defined by a narrowing in the width of the strip at portions 50*c*, 52*c*, 54*c*, respectively. The narrowing portions 50*c*, 52*c*, 54*c* provide an area of weakness to the respective strip 50, 52, 54 whereby the respective strip breaks at the narrowing portions 50*c*, 52*c*, 54*c* upon opening the closure 11 for a first time.

Strip portions 50*b*, 52*b*, 54*b* are integrally joined to the first film layer flap 22 at strip ends 50*d*, 52*d*, 54*d*, respectively. Advantageously, die cut 20 forms the strip ends 50*d*, 52*d*, 54*d* in the shape of parallel "U"'s which help ensure that the strips 50, 52, 54 will not tear at strip ends 50*d*, 52*d*, 54*d* and will remain integrally joined to the first panel 22 and allow the strips 50, 52, 54 to break at the weakened narrowing strip portions 50*c*, 52*c*, 54*c*, respectively.

The second panel 42 remains integrally joined to the inner film layer 12 at end 44, even after the package is opened, and the remainder of the second panel 42 falls down into the opening 24 as described in more detail in the '497 application.

The third tear line 21 defines sealing panel 26 of the outer film layer 13 and the die cuts 25 define a plurality of tab portions 27 in the sealing panel 26. The sealing panel 26 extends beyond the periphery of the first tear line 20 and the second tear line 23 adjacent to the opening 24, so that the sealing panel 26 completely covers and extends beyond the perimeters of the first panel 22, strips 50, 52, 54, and the second panel 42. As a result, sealing panel 26 completely covers the first panel 22, the strips 50, 52, 54, and the second panel 42.

The side of the sealing panel 26 which faces the inner film layer 12, including tab portions 27, is coated with a releasable adhesive 28 (see FIGS. 2*a*, 2*b*) so that the sealing panel 26 may be resealably secured to the inner film layer 12 at a portion adjacent the first panel 22, and so that the tab portions 27 remain permanently affixed to the inner film layer 12.

Alternatively or along with releasable adhesive 28, releasable adhesive can be coated on the inner film layer 12 along the outside perimeter of the first panel 22. The releasable adhesive can be any pressure sensitive adhesive which allows resealing and includes, but is not limited to, the adhesives disclosed in U.S. patent application Ser. No. 11/029,626, herein incorporated by reference. The sealing panel 26 is provided with a tab 30 or other gripping feature which is not coated with adhesive 28 so that the sealing panel 26 may be peeled back from the inner film layer 12 to open the package 10.

Advantageously, the sealing panel 26 has a see-through window portion 29 which lies over the second panel 42 of the inner film layer 12 prior to the package 10 being opened for a first time which permits one to visually observe the second panel 42 adhered thereto prior to the package 10 being opened for a first time and to observe the absence of the second panel 42 attached to the sealing panel 26 after the package 10 has been opened to indicate package integrity as described in the '497 application.

Figure 3:
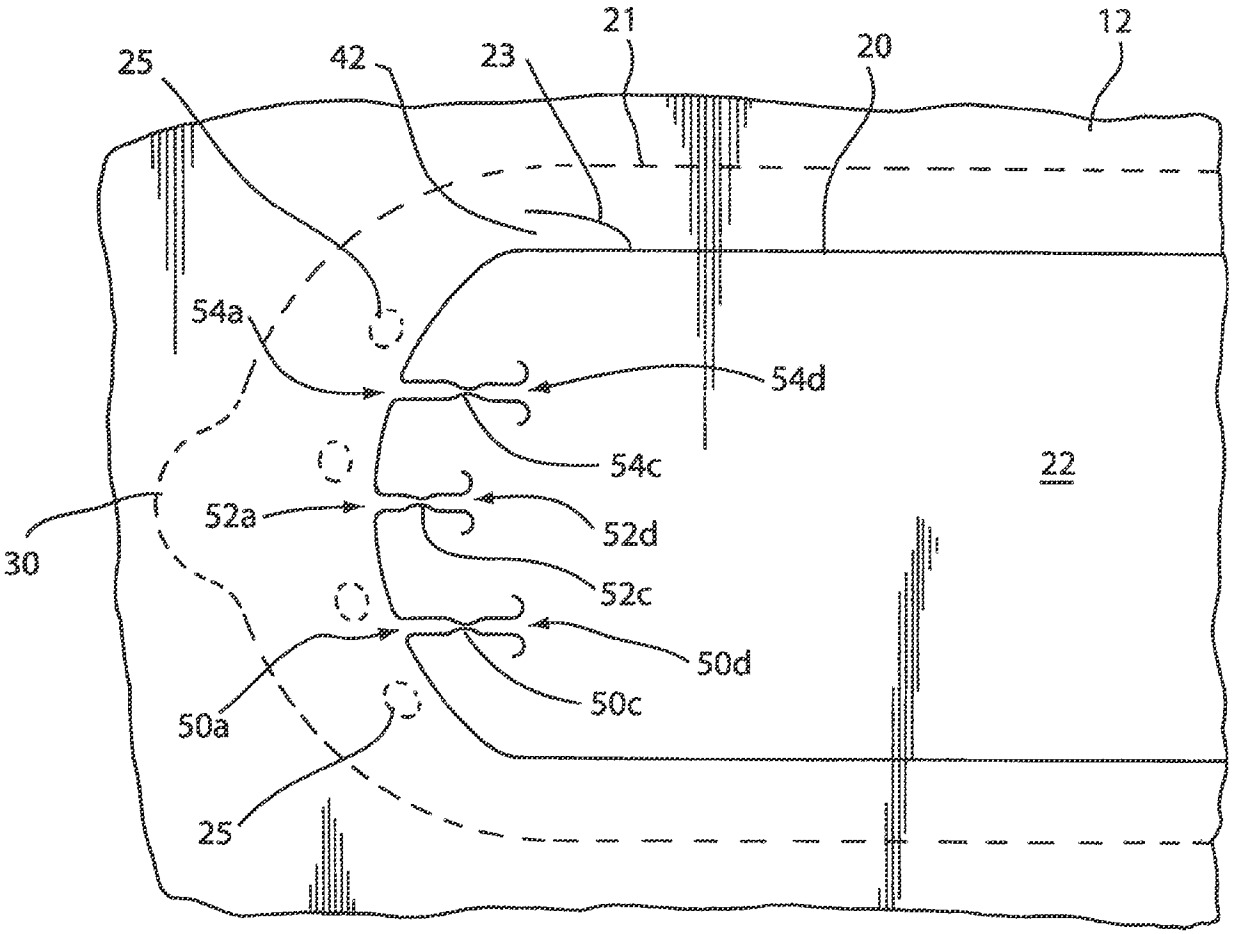
FIG. 3 is a partial plan view of the closure of FIG. 1, as viewed from below in its initial condition prior to being opened for a first time according to the present invention.

Referring now specifically to FIGS. 2*a*, 2*b* and FIG. 3, package 10 is opened by grasping tab 30 and peeling the sealing panel 26 back in the peeling direction as indicated by arrow 33 (FIGS. 2*a*, 2*b*). As the sealing panel 26 is peeled back for a first time, the first panel 22 is separated from the remainder of the inner film layer 12, including the second panel 42 and a portion of the strips 50, 52, 54, along the first film layer tear line 20. Strip portions 50*a*, 52*a*, 54*a* remain integrally attached to the remaining portion of the inner film layer 12, and strip portions 50*b*, 52*b*, 54*b* remain integrally attached to the first panel 22 (FIG. 3). In addition, tab portions 27 separate from sealing panel 26 and remain attached to the inner film layer 12 due to adhesive 28, to thereby form holes 32 in the sealing panel 26 (FIGS. 2 and 3).

Initially, upon opening the closure 11, the strip portions 50*a*, 52*a*, 54*a* separate from the sealing panel 26 while strip portions 50*b*, 52*b*, 54*b* remain attached to the sealing panel 26 as shown in FIG. 2*a*. At some point upon peeling the sealing panel 26 back, ship 52 preferably first breaks at narrowing strip portion 52*c* while strips 50 and 54 remain intact (FIG. 2*a*). When strip 52 breaks, an audible sound, such as a snap is produced. As shown in FIGS. 2*a* and 2*b*, the strips may be spaced apart a distance less than the largest dimension of the contents, shown for example in FIGS. 2*a* and 2*b* as a cookie 58, so that in practice before strip 52 has been broken, the spacing between the strip is too small for removal of a cookie 58.

Pulling the sealing panel 26 further in direction of arrow 33 further opens the closure 11 and eventually strips 50 and 54 break at narrowing strip portion 50*c*, 54*c*, respectively. As each strip breaks an audible sound such as a snap occurs. Advantageously, the strip narrowing portion 50*c*, 54*c* are at the respective same position along the strip 50, 54 so that the strips 50 and 54 break at the same time, thereby producing a unified or single audible sound. Since strip 52 breaks prior to strips 50, 54, two audible sounds are produced, one upon strip 52 breaking, and a second one as strips 50 and 54 break simultaneously.

Package integrity is indicated by closure 11 through several novel features incorporated into the closure 11. Package integrity is indicated visually by one observing the intact integrally joined strips 50, 52, 54 which advantageously break upon opening the closure 11 a sufficient amount prior to allowing one to remove contents therein thereby indicating package integrity. Further, package integrity is indicated by audible sounds produced when the strips break, whereby the audible sound indicates that the package is being opened for a first time.

In addition, package integrity is indicated by the visual indication of a portion 34 of the sealing panel 26, shown as black outlined letters for the word "SEALED," and a portion 36 of the inner film layer 12 spanning a portion of the panel 22, shown as being gray, which is viewable through the window portion 29 prior to the closure 11 being opened for a first time (FIG. 1), and a middle portion of the word "SEALED" having a void 46 which void exists because the second panel 42, which was present and intact before the package was opened the first time, has now fallen down in the package and is not visible in the void area 46. The void area 46 is thus shown as not shaded after the closure has been opened and resealed (FIG. 4).

Figure 4:
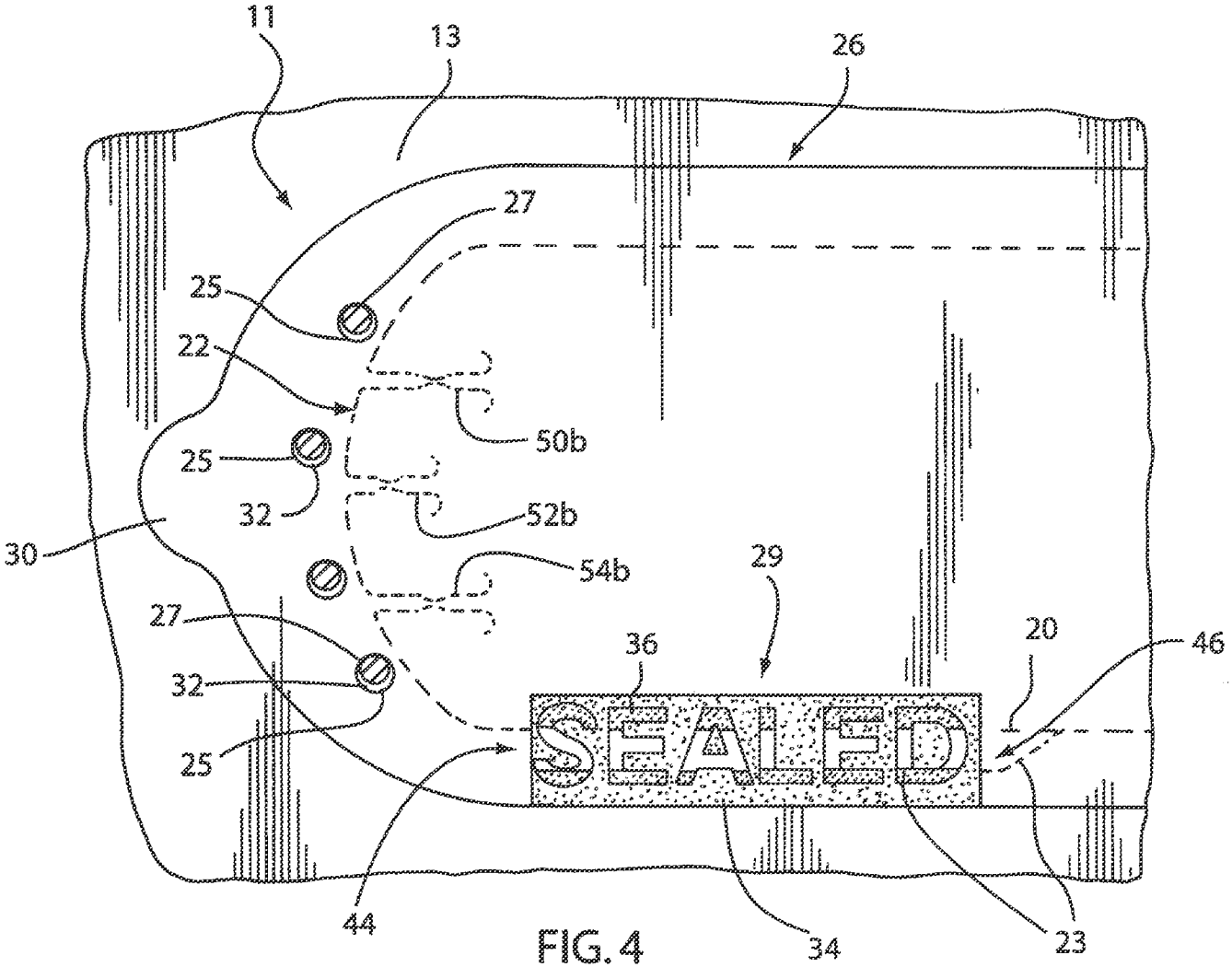
FIG. 4 is a partial plan view of the closure of FIG. 1, after an initial opening and reseal, according to the present invention.

Further, since the sealing panel 26 does not generally return to its exact original position, but instead is slightly misaligned relative to its original position, package integrity is indicated by such misalignment of the sealing panel holes 32 with the tab portions 25 after the sealing panel 26 has been opened and resealed (FIG. 4).

Figure 5:
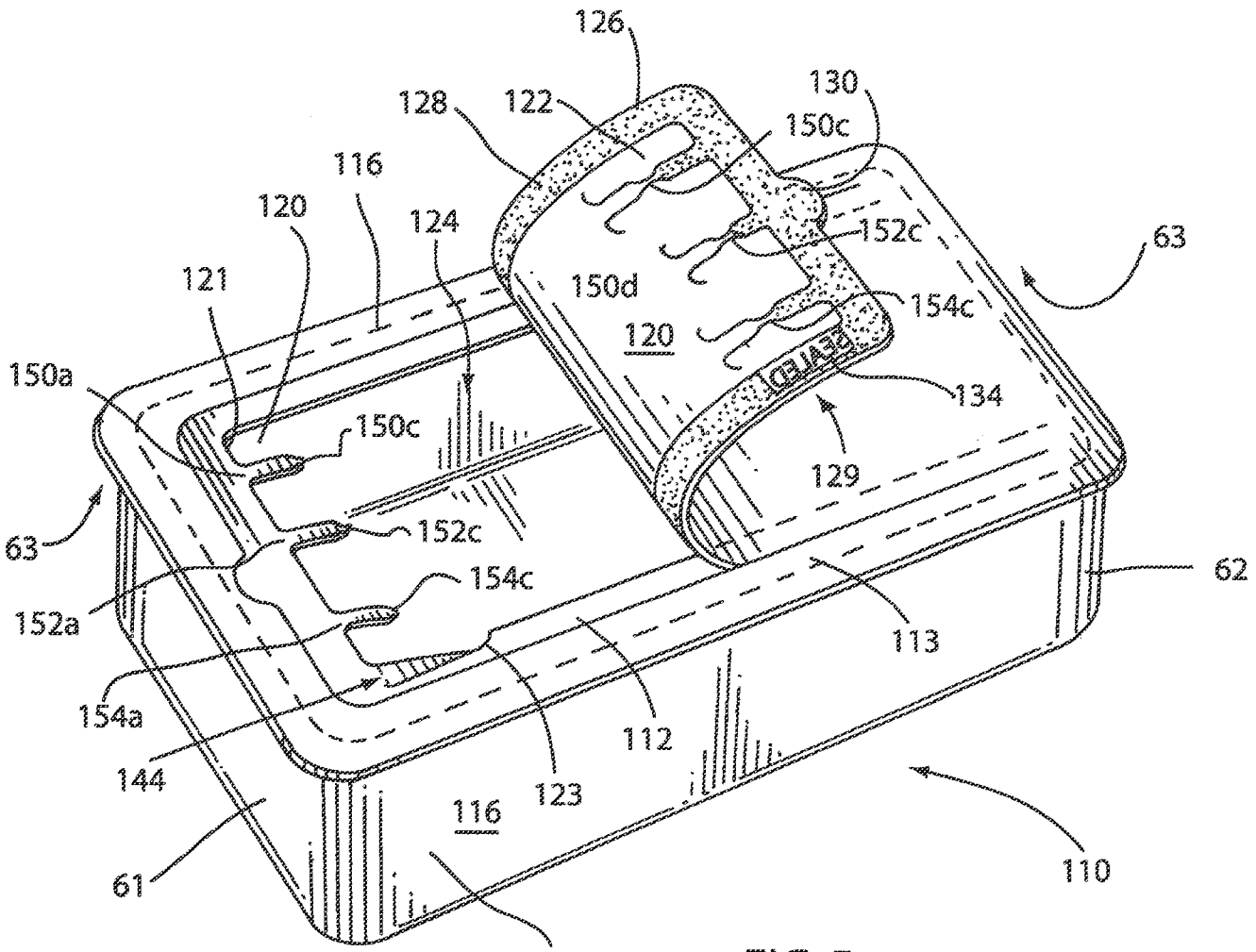
FIG. 5 is a perspective view of another package, including a closure that has been opened, in accordance with the present invention.

Referring to FIG. 5, like elements to those of the embodiment of FIGS. 1-4 are increased by 100. Package 110 comprises a thermal formed tray 60 which forms the sides 116 and ends 61, 62. A two-ply film material comprising an inner film layer 112 and a outer film layer 113 are sealed to flange 63 of the thermal formed tray 60. Like package 10, pulling back on tab 130 separates the sealing panel 126 from the outer film layer 113 and separates the first panel 122 from the inner film layer 112, portions of the strips 150, 152, 154 and the second panel 142. After package 110 has been opened for a first time, the strips 150, 152, 154 will break at narrowing strip portions 150*c*, 152*c*, 154*c* producing an audible sound upon breaking and providing a visual indication of package integrity status that the package has been previously opened as shown in FIG. 5.

Package 110 can be used for various food items, such as cheese, sliced meats and the like. In addition, package 110 can be used for semi-sold items, such as pudding and yogurt. Although package 110 is depicted as having a rectangular shape, the package 110 can have any shape, including cylindrical and irregular.

The inner and outer film layers 112, 113 may be formed of the same material as layers 12, 13, which includes polypropylene, polyethylene, cellophane or any other polymeric material suitable for forming a package enclosure.

Figure 6:
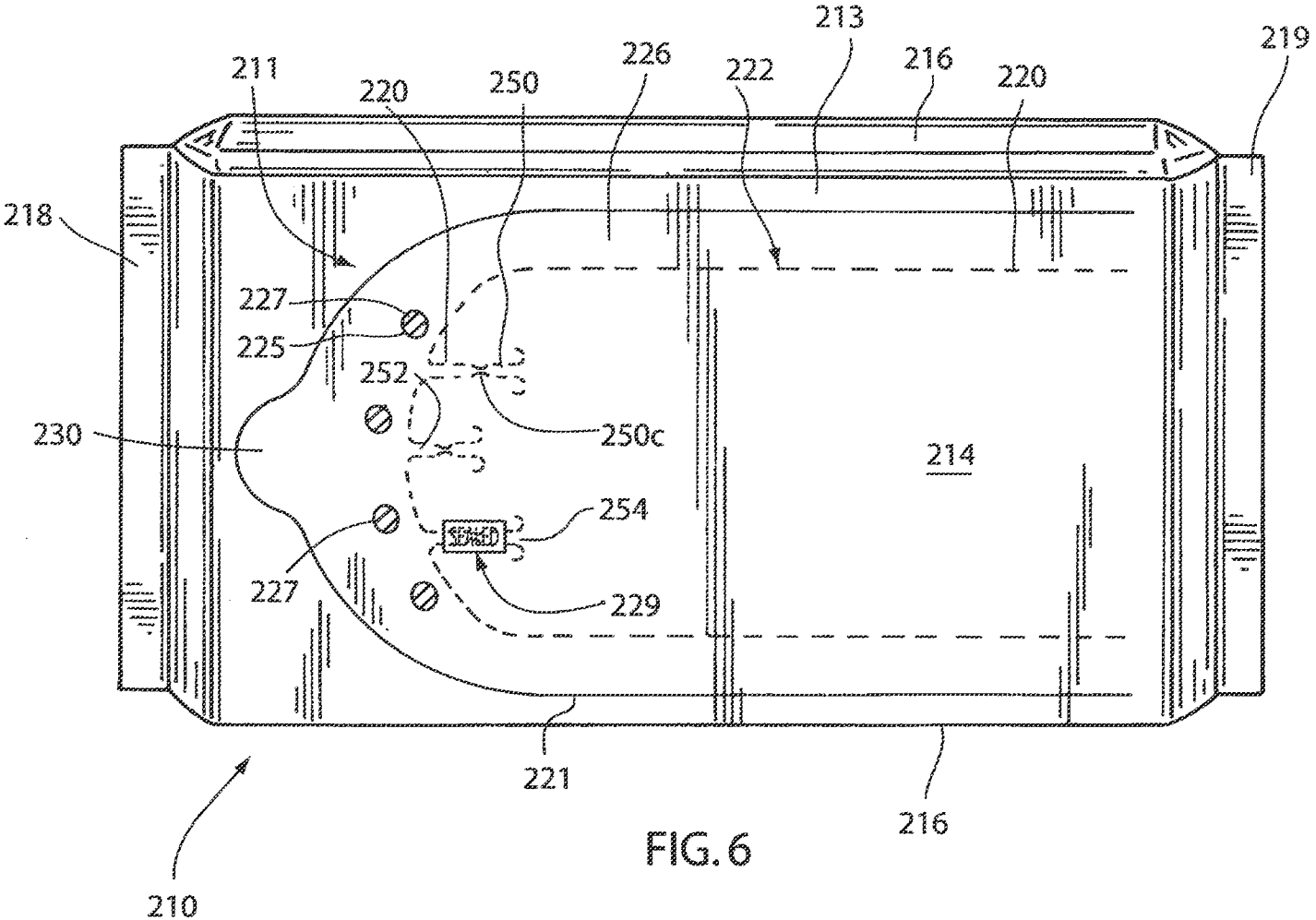
FIG. 6 is a perspective view of another package, including another closure prior to an initial opening, according to the present invention.
Figure 7:
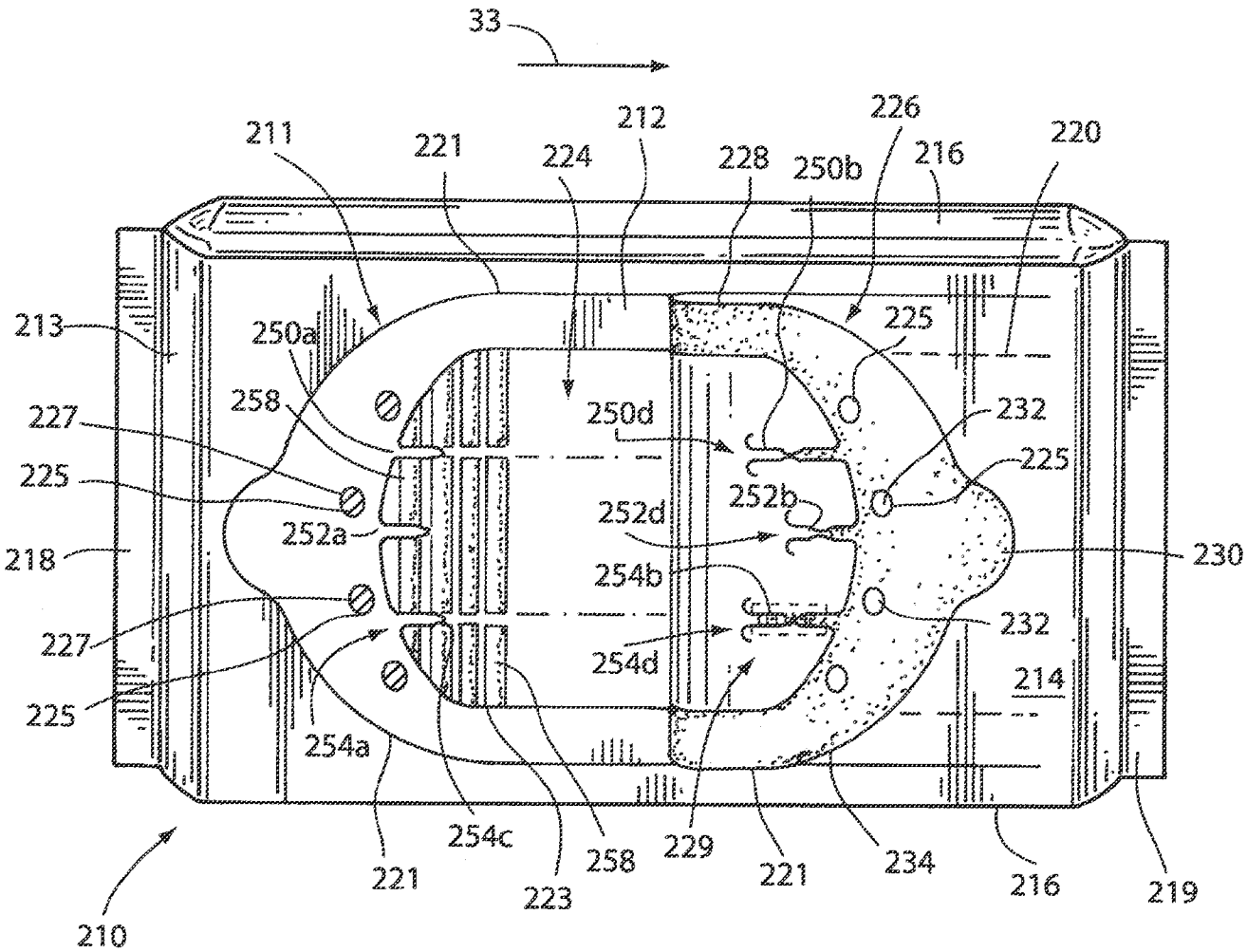
FIG. 7 is the package of FIG. 6, shown in a partially opened condition.
Figure 8:
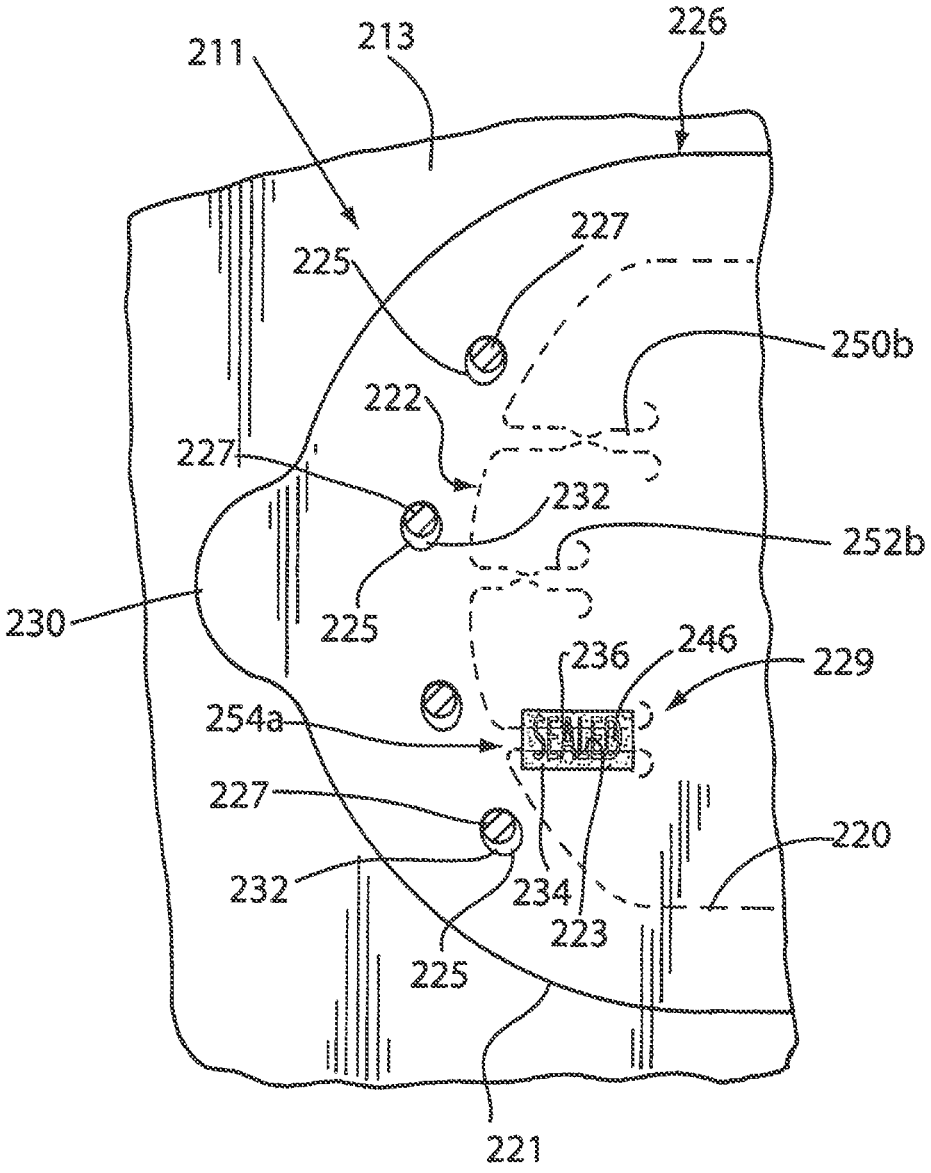
FIG. 8 is a partial plan view of the closure of FIG. 6, after an initial opening and reseal, according to the present invention.

Referring now to FIGS. 6-8, like elements of the embodiment of FIGS. 1-4 are increased by 200. The sealing panel 226 has a see-through window portion 229 which lies over strip 254 of the inner film layer 212 prior to the package 210 being opened for a first time, which permits one to visually observe the strip 254 adhered thereto prior to the package 210 being opened for a first time. Like package 10, pulling back on tab 230 separates the sealing panel 226 from the outer film layer 213 and separates the first panel 222 from the inner film layer 22 and portions of strips 250, 252 and 254. After package 210 has been opened for a first time, the strips 250, 252, 254 will break at narrowing strip portions 250*c*, 252*c*, 254*c*, producing an audible sound upon breaking, and providing a visual indication of package integrity status that the package has been previously opened, as shown in FIG. 7. In addition, package integrity status is evidenced by the absence of portions of the strip 254 being attached to the sealing panel 226 after the package 210 has been opened.

Figure 9:
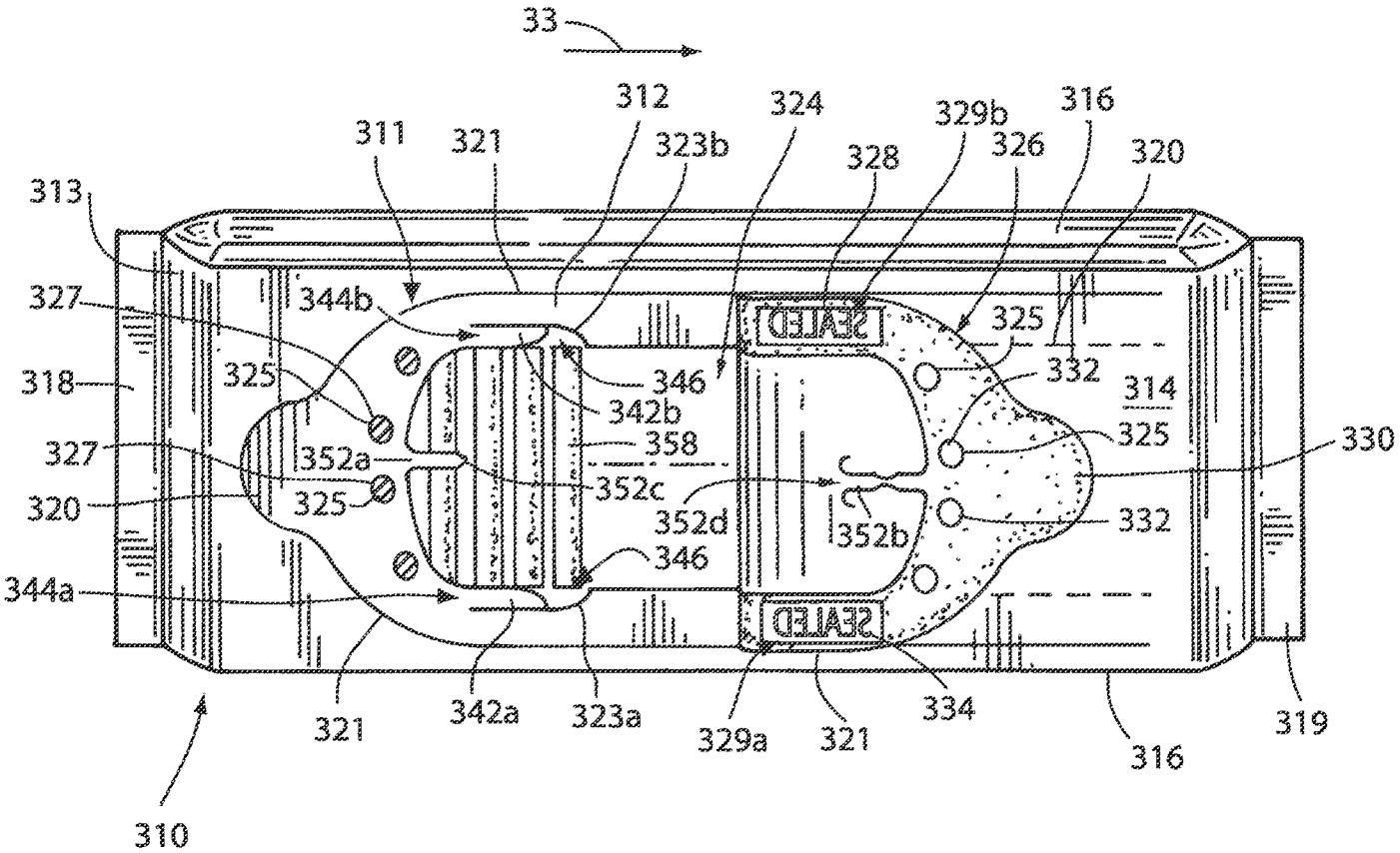
FIG. 9 is a perspective view of another package, including another closure, shown in a partially opened condition.
Figure 10:
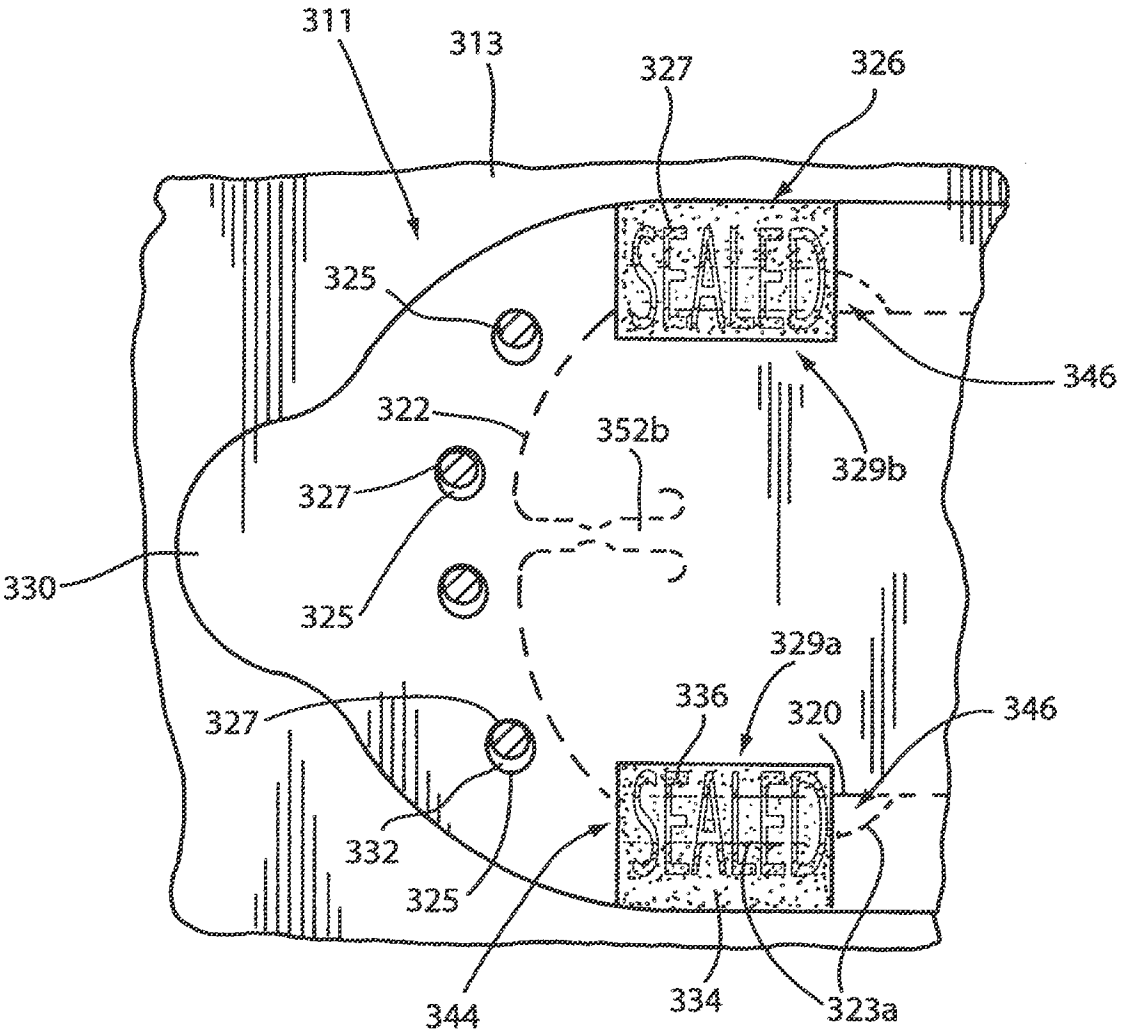
FIG. 10 is a partial plan view of the closure of FIG. 9, after an initial opening and reseal, according to the present invention.

Referring now specifically to FIG. 8, package integrity status is also indicated by the visual indication of a portion 234 of the sealing panel 226, shown as black outline letters for the word "SEALED," prior to the closure 211 being opened for a first time (FIG. 6), and a middle portion of the word "SEALED," having a void 246 which void exists because the strip 254 which was present and intact before the package was opened the first time has now fallen down into the package and is not visible at void 246. This void 246 is thus shown as not shaded after the closure has been opened and resealed (FIG. 5). In addition, like package 10, package integrity status is indicated by a slight misalignment of the sealing panel holes 232 with the tab portions 225 after the sealing panel 226 has been opened and resealed (FIG. 6) in a similar manner as package 10. Referring now to FIGS. 9 and 10, in accordance with another embodiment, package 310 has a single strip 352 located at a mid-portion of the opening 324. Package 310 is designed to accommodate a single row of food items, such as cookies 358.

Referring now to FIGS. 9 and 10, in accordance with another embodiment, package 310 has a single strip 352 located at a mid-portion of the opening 324. Package 310 is designed to accommodate a single row of food items, such as cookies 358.

Tear lines 323*a* and 323*b* form a pair of integrity indicating panels 342*a*, 342*b*, respectively. When the package 310 is opened for a first time, the panels 342*a*, 342*b* remain integrally joined to the inner film layer 312 at end 344*a*, 344*b*, even after the package 310 is opened, and the remainder of the panels 342*a*, 342*b* fall down into the opening 324, as described in more detail in the '497 application.

Package 310 includes a sealing panel 326 with a pair of see-through window portions 329*a*, 329*b* which lie over panels 342*a*, 342*b*, respectively, of the inner film layer 312 prior to the package 310 being opened for a first time. The see-through windows 329*a*, 329*b* permit one to visually observe the panels 342*a*, 342*b* adhered thereto prior to the package 310 being opened for a first time and to observe the absence of the sealing panels 342*a*, 342*b* attached to the sealing panel 326 after the package 310 has been opened to indicate package integrity status.

Once package 310 has been opened and resealed, package integrity status is evidenced by the absence of the panels 342*a*, 342*b* attached to the sealing panel 326 in a similar manner as indicated for second panel 42 in package 10. In addition, like package 10, the integrity of package 310 is observable by a misalignment of the sealing panel holes 332 with the tab portion 325 after the sealing panel 326 has been opened and resealed (FIG. 11). Further package integrity status is provided by an audible sound as strip 352 breaks when package 310 is opened for a first time.

The present invention specifically shows embodiments with three rows of food products (such as cookies) with three strips and with a single row of food products (such as cookies) and a single strip. It is to be understood that the invention is applicable to packages with any number of rows of food products, wherein the number of strips will be selected as desired, considering the number of rows of food products, the width of the package and the desired spacing of the strips. Also, different sized packages can employ any desired number of windows, whether such windows lie over second or third panels or over one or more strips. In addition, the food products can be arranged in rows across the package, or the food product may involve no rows at all, such as for peanuts. In any of these arrangements, the present invention can include any suitable number of strips and/or any suitable number of sealed windows.

As will be apparent to one of ordinary skill in the art that the present package integrity feature of the present closure offers benefits over prior tamper-evident or package integrity features.

The invention claimed is:

1. A package having a package integrity feature, the package comprising:

a wrapper forming a top, sides, and a bottom of the package, the wrapper being a two-ply material with first and second layers;

a closure formed in the two-ply material at the top being defined by a first cut formed in the first layer defining a first panel and a second cut formed in the second layer defining a second panel, the closure being separable from a remainder of the first and second layers to expose an access opening;

an elongated frangible strip connecting the closure with the remainder of the package, the elongated frangible strip defined by a pair of elongated cuts and having a first end and a second end and a frangible area in between the first end and second end; and upon initial opening of the package, the frangible strip breaks along the frangible area, thereby providing a visual indication of the package being opened.

2. The package of claim 1 wherein the closure comprises a free end portion and a fixed end portion, and the frangible strip being associated with the free end portion.

3. The package of claim 2 wherein the closure further comprises a starter portion disposed adjacent the free end portion, the starter portion graspable by a user to peel the closure back from the remainder of the package, the starter portion being disposed relative to the frangible strip so that the starter portion is movable prior to the frangible strip breaking.

4. The package of claim 1 wherein the second layer is disposed over the first layer.

5. The package of claim 4 wherein the second panel completely covers the first panel.

6. The package of claim 4 wherein the frangible strip is cut into the first layer with one end integrally formed with the first panel and another end integrally formed with a remainder of the first layer.

7. The package of claim 1 wherein the package contains food items.

8. The package of claim 1 wherein an intact frangible strip provides a visual indication that the package has not been previously opened.

9. The package of claim 1 wherein a broken frangible strip provides a visual indication that the package has been previously opened.

10. The package of claim 1 wherein the pair of elongated cuts extend away from a portion of an edge of the closure.

11. The package of claim 1 wherein the elongated frangible strip includes a weakened portion.

12. The package of claim 11 wherein the weakened portion is in the form of a narrowing of a portion of the elongated frangible strip.

13. The package of claim 1 wherein the elongated frangible strip breaks into two portions upon the initial opening of the package.

14. A package comprising:

a two-ply structure forming a top, sides, and bottom of the package;

a closure formed in the two-ply structure, the closure capable of being separated at least in part from the package to expose an access opening;

the closure is defined by two off-set cuts partially disposed through the two-ply structure;

a breakable structure connecting the closure to a remainder of the two-ply structure, wherein the breakable structure is defined by a pair of elongated side cuts in the two-ply structure, the breakable structure disposed between the pair of elongated side cuts, the pair of elongated side cuts and the breakable structure extending transverse to the off-set cuts; and the closure having a starter portion graspable by a user to peel the closure back to separate the closure at least in part from the package to expose the access opening, the starter portion being disposed relative to the breakable structure so that the starter portion is movable prior to the breakable structure breaking.

15. The package of claim 14 wherein the closure comprises a flap formed in a first layer of the two-ply structure and a sealing panel formed in a second layer of the two-ply structure.

16. The package of claim 15 wherein the top of the package is oriented such that the sealing panel covers the flap.

17. The package of claim 14 further comprising releasable adhesive disposed at least in between portions of the two-ply structure.

18. The package of claim 14 wherein the package is resealable such that the access opening can be resealed after the closure has been separated at least in part from the package.

19. The package of claim 14 wherein the two off-set cuts include a first cut disposed is a first layer of the two-ply structure and a second cut disposed in a second layer of the two-ply structure.

20. The package of claim 14 wherein the breakable structure comprises an elongated strip of flexible film having sides defined by the pair of elongated side cuts.

21. The package of claim 14 wherein the breakable structure includes a weakened portion.

22. The package of claim 21 wherein the weakened portion comprises a narrowing of a portion of the breakable structure.

23. The package of claim 14 wherein the breakable structure breaks into two portions upon initial package opening.

* * * * *